US008199009B2

(12) United States Patent
Brunetti

(10) Patent No.: US 8,199,009 B2
(45) **Date of Patent: *Jun. 12, 2012**

(54) METHOD AND SYSTEM FOR ADMINISTERING REMOTE AREA MONITORING SYSTEM

(75) Inventor: Sam F. Brunetti, Falls Church, VA (US)

(73) Assignee: BAS Strategic Solutions, Inc., Gainsville, VA (US)

( * ) Notice: Subject to any disclaimer, the term of this patent is extended or adjusted under 35 U.S.C. 154(b) by 698 days.

This patent is subject to a terminal disclaimer.

(21) Appl. No.: 12/288,777

(22) Filed: Oct. 22, 2008

(65) Prior Publication Data

US 2011/0007139 A1 Jan. 13, 2011

Related U.S. Application Data

(63) Continuation-in-part of application No. 12/131,615, filed on Jun. 2, 2008.

(60) Provisional application No. 60/942,872, filed on Jun. 8, 2007.

(51) Int. Cl.
*G08B 13/00* (2006.01)

(52) U.S. Cl. ..... 340/541; 340/540; 340/573.4; 340/506; 348/153

(58) Field of Classification Search ..... 340/541, 340/905, 917, 925, 540, 573.4, 506, 522, 340/565, 568.1, 573.1, 545.7, 545.1, 609, 340/5.1; 348/149, 153, 154; 705/1, 10, 705/159, 163

See application file for complete search history.

(56) References Cited

U.S. PATENT DOCUMENTS

| | | | | |
|---|---|---|---|---|
| 6,144,363 | A * | 11/2000 | Alloul et al. | 345/618 |
| 6,597,391 | B2 * | 7/2003 | Hudson | 348/153 |
| 7,167,094 | B2 * | 1/2007 | Ciarcia et al. | 340/568.1 |
| 7,535,353 | B2 * | 5/2009 | Hirai et al. | 340/541 |
| 7,671,728 | B2 * | 3/2010 | Buehler | 340/506 |

* cited by examiner

*Primary Examiner* — Anh V La

(74) *Attorney, Agent, or Firm* — Polster, Lieder, Woodruff & Lucchesi, L.C.

(57) ABSTRACT

A remote area monitoring system is configured to detect movement in a disallowed direction through a space. The system monitors two volumetric spaces that are established by the system, both of which spaces are defined with respect to depth, width and height. In one embodiment, the system includes one or more stereoscopic sensors for capturing image information of the space, a processor processing the image information to detect movement of humans or objects in a disallowed direction through the space, and an alarm indicator. The system may also include workstation configured to display and store the image information. The workstation may have multiple levels of access, such as basic user, supervisor and technician level access. The workstation may display a log of alarm or related events and permit selection of events and viewing of image information associated with the events.

15 Claims, 18 Drawing Sheets

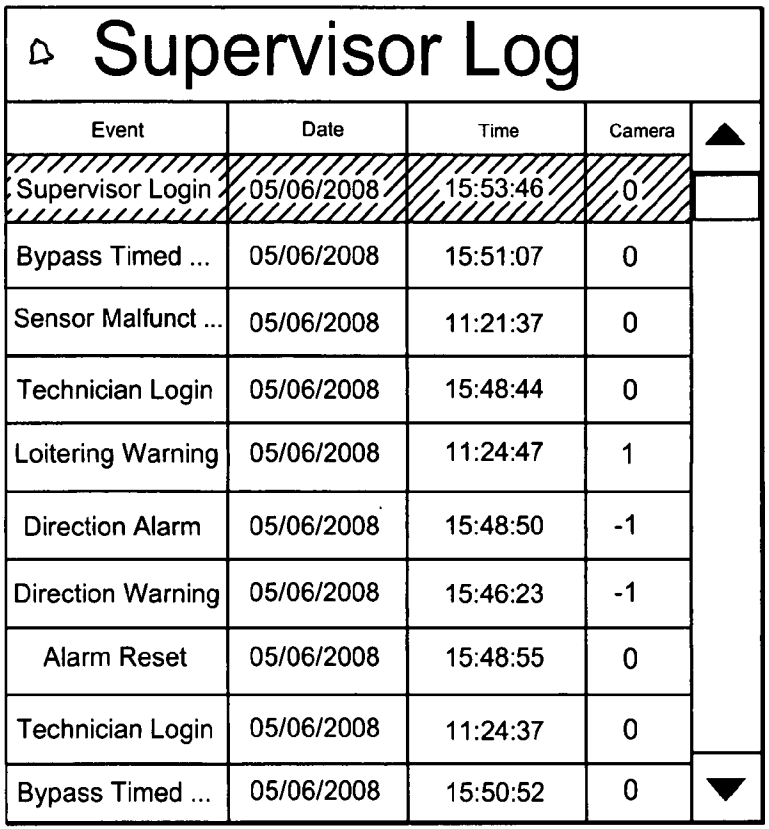

Supervisor Log

| Event | Date | Time | Camera |
|---|---|---|---|
| Supervisor Login | 05/06/2008 | 15:53:46 | 0 |
| Bypass Timed ... | 05/06/2008 | 15:51:07 | 0 |
| Sensor Malfunct ... | 05/06/2008 | 11:21:37 | 0 |
| Technician Login | 05/06/2008 | 15:48:44 | 0 |
| Loitering Warning | 05/06/2008 | 11:24:47 | 1 |
| Direction Alarm | 05/06/2008 | 15:48:50 | -1 |
| Direction Warning | 05/06/2008 | 15:46:23 | -1 |
| Alarm Reset | 05/06/2008 | 15:48:55 | 0 |
| Technician Login | 05/06/2008 | 11:24:37 | 0 |
| Bypass Timed ... | 05/06/2008 | 15:50:52 | 0 |

FIG. 13A

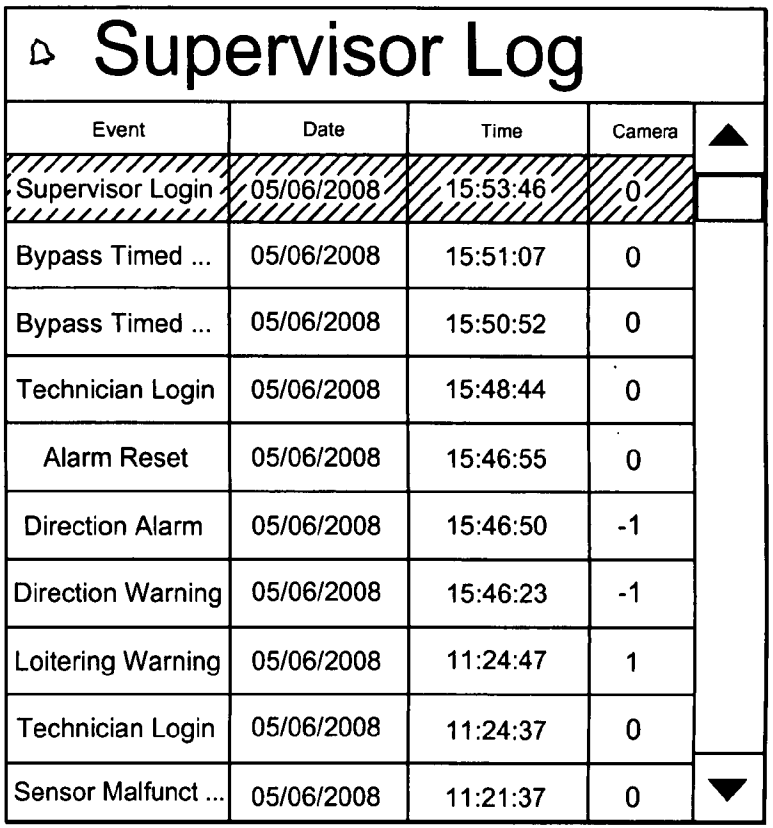

Supervisor Log

| Event | Date | Time | Camera |
|---|---|---|---|
| Supervisor Login | 05/06/2008 | 15:53:46 | 0 |
| Bypass Timed ... | 05/06/2008 | 15:51:07 | 0 |
| Bypass Timed ... | 05/06/2008 | 15:50:52 | 0 |
| Technician Login | 05/06/2008 | 15:48:44 | 0 |
| Alarm Reset | 05/06/2008 | 15:46:55 | 0 |
| Direction Alarm | 05/06/2008 | 15:46:50 | -1 |
| Direction Warning | 05/06/2008 | 15:46:23 | -1 |
| Loitering Warning | 05/06/2008 | 11:24:47 | 1 |
| Technician Login | 05/06/2008 | 11:24:37 | 0 |
| Sensor Malfunct ... | 05/06/2008 | 11:21:37 | 0 |

FIG. 13B

METHOD AND SYSTEM FOR ADMINISTERING REMOTE AREA MONITORING SYSTEM

RELATED APPLICATION DATA

This application is a continuation-in-part of U.S. application Ser. No. 12/131,615, filed Jun. 2, 2008, which claims priority to U.S. Provisional Patent Application Ser. No. 60/942,872, filed Jun. 8, 2007.

FIELD OF THE INVENTION

This invention relates to a method and apparatus for remotely monitoring an area of interest; for example, a pedestrian passageway such the entrance into, and exit from, a concourse in an airport terminal; and more particularly, to detecting a security breach resulting from inadvertent or intentional wrong way travel of people and objects through an exit passageway and to provide an immediate and specific indication thereof.

BACKGROUND OF THE INVENTION

For some time now, airport concourses have been secured areas to which only authorized individuals (employees or screened passengers) are permitted access. Nonetheless, these are areas of high traffic volume with large groups of people going in one direction to reach a gate, and in the opposite direction to retrieve their luggage, access parking or ground transportation, etc. While perhaps the readiest example of a high volume, secure area, there are other areas such as those in government offices, military facilities, etc. where relatively large numbers of people are constantly moving into and out of secure areas.

It is commonplace with these secure areas that while access into the area requires movement through some type of screening, the exit passageways are relatively open. That is, there are usually no fixed barriers such as doors or gates through which a person has to pass so that people can move rapidly and unencumbered through the exit. However, there is usually at least one guard posted in this egress passage to prevent people from entering into the secure area through it, thereby bypassing the security screening. While guards are usually effective, there are, nevertheless, numerous instances of security breaches in which someone has gotten past the guard and escaped into the secure area. When this occurs in an airport, the concourse is typically evacuated, and all passengers waiting for planes have to be re-screened. As a result, numerous flights are delayed, all at an enormous cost in time and money to the airport, the airlines, and the passengers.

Studies have shown that security guards or monitors, regardless of how dedicated, do not provide the vigilance that is required for prolonged periods of time. After a while, they become tired and can be distracted. Or, it is not uncommon for a guard to be diverted from his or her task in order to render assistance to someone in need. In either instance, the way is made clear for a wrong-way traveler to enter into the secure area through the exit passage, and to do so undetected.

It is known for airport security systems to include video monitors installed in an exit passage to view movement of people through the passage. It is also known to sense wrong-way movement of people in this area, and to "sound" an alarm when wrong-way movement is detected. Typically, when an alarm occurs, frames of imagery showing the passage and the people in it at the time of the alarm are captured and analyzed. A drawback with conventional analysis is that it looks for movement only in one direction through the passage. This is so, even though these systems may be capable of perceiving movement in both directions.

SUMMARY OF THE INVENTION

The present disclosure is directed to a Remote Area Monitoring System (RAMS™) which is installed in security environments where detection of people or objects moving in a disallowed direction is critical and a rapid response to a detected movement necessary. The RAMS employs both a method and apparatus for passively and unobtrusively detecting movement within an area of interest such as a passageway without impeding traffic flow through the passageway. Detection apparatus of the system monitors two volumetric spaces that are established by the system. Both of these spaces are zonally defined with respect to depth, width, and height. One defined space comprises a warning zone and the other defined space an alarm zone. The warning zone is monitored against inadvertent incursion into a protected space; while the alarm zone is monitored against intentional intrusions thereinto. Besides detecting and warning of incursions or intrusions, the system further detects undue loitering in either zone and provides an alert or warning to a system monitor.

The apparatus automatically monitors both zones, simultaneously, and does not require human vigilance to detect and warn of an incursion, intrusion, or loitering. The apparatus monitors human traffic, in both directions through the zones; as well as the movement of objects propelled through the zones whether the objects are thrown or tossed through the air, or slid or rolled along a floor. For the detection of humans, the apparatus employs reliable machine vision technology including multiple overhead modules linked together so to completely cover the passageway through which pedestrians travel and to monitor the movement of people from frame to frame of the processed video. Areas covered by the modules overlap so to insure that there are no gaps in coverage. Near infrared (IR) imaging techniques are used, in one embodiment, to detect thrown or tossed objects. Detected people and objects are viewed using high resolution cameras.

In one embodiment, the system includes a workstation. The workstation may comprise a computing device and at least one display configured to display system-related information, such as image information captured by the system. The workstation may include one or more data storage devices, such as digital video recorders, for storing the image information.

The workstation may store image information associated with alarm or warming events. This information is date and time stamped, and the location is also recorded. Alarm event information may be automatically replayed, and warning event information may be replayed when requested. Archived information is retrievable from the workstation, such as via an event log. This data can be transmitted to other sites for permanent archiving and analysis, and printouts of pertinent information is done onsite.

In one embodiment, the workstation may be configured for multi-level access, such as basic user level access, supervisor level access, and technician level access. The different levels of access may permit access to different features or information of the system. The workstation may also generate one or more graphical user interfaces relative to the different levels of access.

The RAMS is readily customized so that the same platform can be used in a wide variety of installations. Once in operation, the system reduces the workload otherwise imposed on security or monitoring personnel while insuring that area security is constantly maintained.

Further objects, features, and advantages of the present invention over the prior art will become apparent from the detailed description of the drawings which follows, when considered with the attached figures.

DESCRIPTION OF THE DRAWINGS

FIG. 13A illustrates an unsorted supervisor event log;

FIG. 13B illustrates a sorted supervisor event log;

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
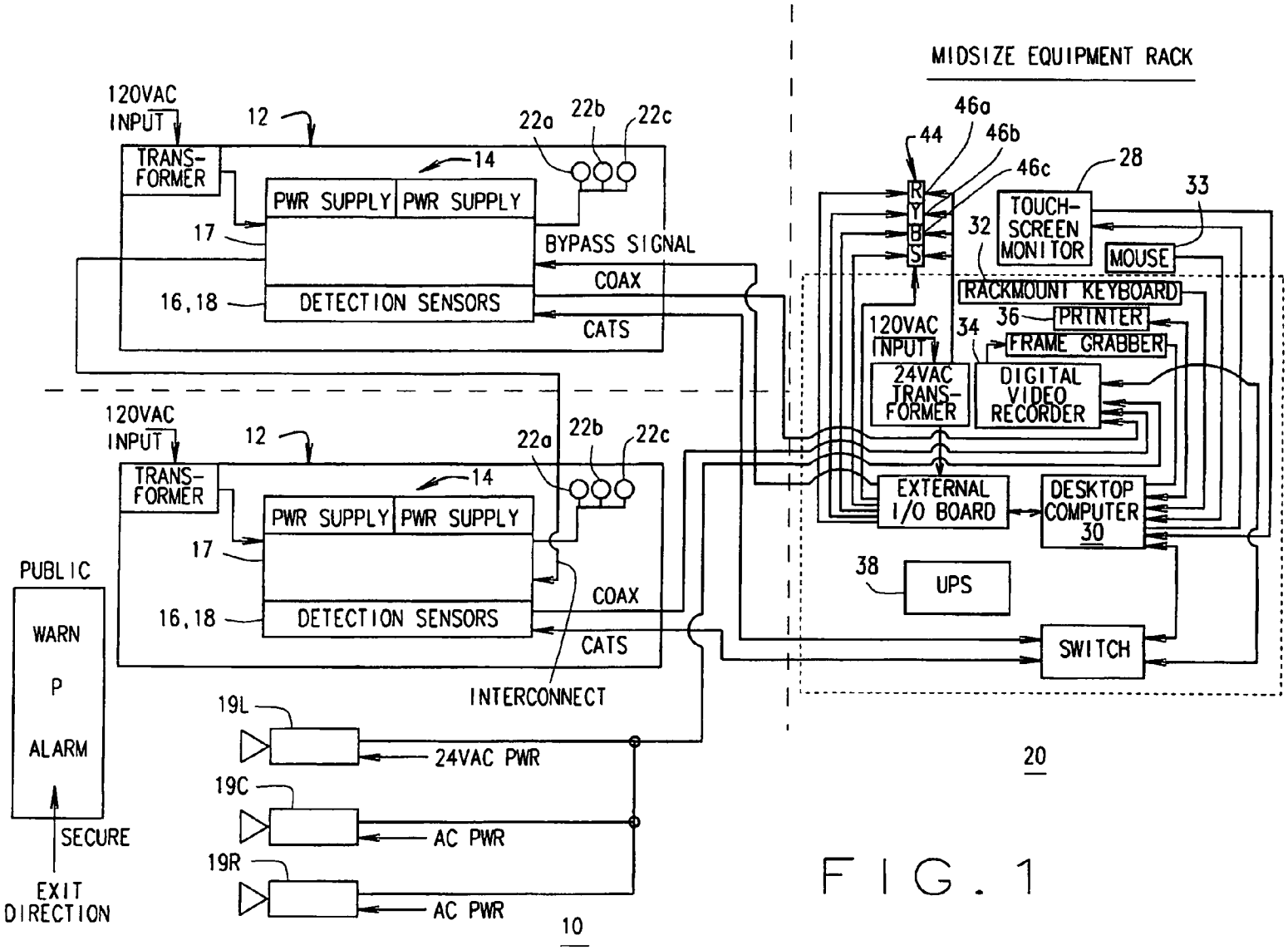
FIG. 1 is a block diagram of the remote area monitoring system of the present invention and illustrating the interconnection of the components of the system.

One embodiment of the invention is a remote area monitoring system (hereinafter "RAMS"), as indicated generally 10 in FIG. 1. The RAMS includes an overhead module 12 in which is mounted a sensor suite 14 that monitors a volumetric area defined in depth, width, and height. As shown in FIG. 1, this area includes both a warning zone and an alarm zone. RAMS 10 automatically monitors the activities in a pedestrian passageway P for wrong-way travel into a secured area; this being done without impeding exit traffic flow. Using advanced machine vision sensing technologies as described hereinafter, RAMS 10 generates an alarm if a security breach is detected. In one embodiment of the invention, a sensor 16 of sensor suite 14 monitors the direction of travel of larger, slower moving objects such as people; while a second sensor 18 tracks small, fast moving objects that are tossed, slid or rolled through the passage. In a second embodiment of the invention, the sensor 16 performs both monitoring functions; while in a third embodiment a plurality of cameras 19 shown in FIG. 1 are used for object detection. A processor 17 incorporated in a printed circuit board in module 12 processes the video signal inputs from the various sensors. Alternatively, each camera or sensor can include a "mini" processor for processing the video signals. Regardless, the processor, or processors, includes video analysis software including algorithms for distinguishing between individuals, individuals and objects, and the directions of movement of both.

Figure 5:
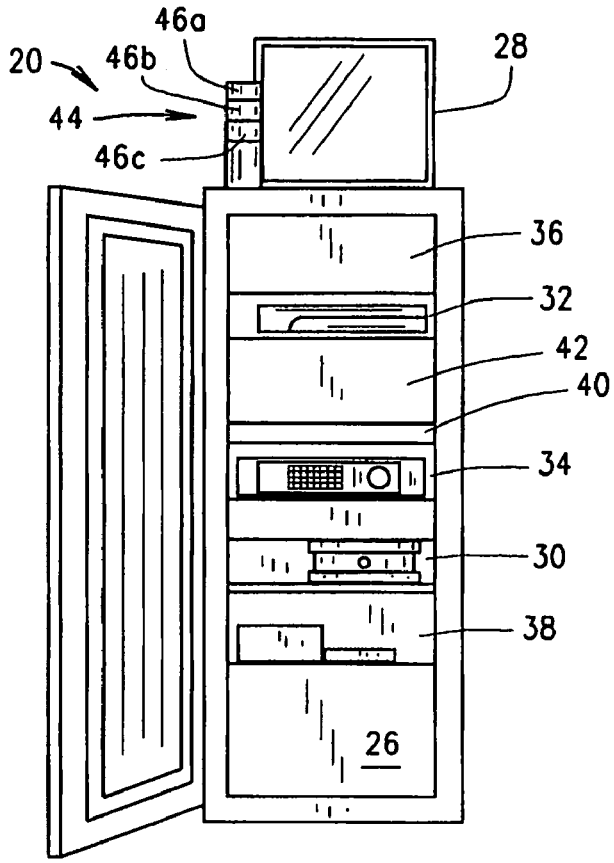
FIG. 5 is an elevation view of an operator workstation used in the system.

Next, RAMS 10 includes an operator workstation 20 which, as shown in FIG. 5 is a self-contained, remote unit. The workstation includes a rack 26. Mounted in, or on, the rack are a number of components. Interconnection between these components, and between the modules 12 and the workstation is diagrammatically shown in FIG. 1. The workstation 20 may be configured to be mobile.

Installed on top of rack 26 is a monitor 28 which is, for example, a 17" color flat panel touch screen monitor mounted on a stand which allows it to be swiveled by an operator for easy viewing and controls of the operator functions.

Next, the workstation includes a desktop or personal computer (PC) 30 with associated keyboard 32 and mouse 33. PC 30 is, for example, a Pentium 0 820/2.80 GHz 2X1 M PC which manages the operator's interface with the system. This includes diagnostic functions, maintenance procedures, and supervisory access to system settings.

The mouse is a silicone-based, optical mouse used because it is durable in an environment where it is continuously exposed to the public. The mouse is impervious to liquids (water, coffee) and cleaning fluids that may come into contact with it, is washable and can be disinfected with standard aerosol cleaners. In a preferred configuration, this mouse is used for system set-up and not by the operator during normal operation (during normal operation, input is preferably simplified via use of the touch-screen, such via controls displayed thereby as detailed below).

The workstation further includes a digital video recorder (DVR) 34 which is, for example, a 16 channel DVR that records all event imagery. Using the DVR, video data can be retrieved for replay, or to print frames of imagery (screen shots) for use in intruder apprehension. DVR 34 is programmed to record, for subsequent display, the five seconds of video occurring before an alarm event, and five seconds of the video occurring thereafter. A printer 36 included in the workstation is a photo-quality printer that allows an operator to print screen shots for use in intruder apprehension.

A power backup (UPS) 38 is also mounted in rack 26. This unit is, for example, an ES 725 VA with phone and coax protection. The UPS provides surge protection and battery backup. Four power outlets are provided for battery backup and four power outlets are provided for surge protection.

Rack 26 includes a work surface 40, and/or a utility drawer 42. The rack enclosure is equipped with a closable, lockable Plexiglas door 43 to protect the components installed in the rack.

Installed on top of rack 26 is a light stack or light bar 44. The light stack includes three lights, a top (red) light 46*a*, a middle (yellow) light 46*b*, and a lower (blue) light 46*c*. The function of these lights is described hereinafter.

Those skilled in the art will appreciate that RAMS 10 can be employed as a standalone exit lane monitoring system in conjunction with a ingress or checkpoint screening system. RAMS 10 is installed in security environments where detection of people or objects moving in a disallowed direction is critical and a rapid response to a detected movement necessary, but in which it is important, if at all possible, to preclude drastic security measures such as evacuation of a building or concourse. Further, the system is a flexible and versatile system readily adapted to a variety of installations and for simultaneous monitoring of multiple exits. Those skilled in the art will understand that RAMS 10 can be installed with or without the Thrown Object Detection Device (or TODD™) capability depending upon the requirements for a particular installation.

Because machines perform better at certain vigilance tasks than humans, RAMS 10 is more effective than a human guard at monitoring passageway P for wrong-way, disallowed directions of travel. RAMS 10 can detect wrong-way travel of both people and fast-moving objects that are tossed, slid, or rolled into the secured area, and records alarm and warning events for use in post-event analysis and intruder apprehension. A significant advantage of RAMS 10 is that it allows for a reduction in the number of guards or monitors stationed at egress passages. Since current airport locations usually require at least one guard at each concourse exit, RAMS 10 can produce substantial savings in personnel costs while, at the same time, performing more effective monitoring.

RAMS 10 employs both a method and apparatus for passively and unobtrusively detecting movement within an area of interest such as a passageway without impeding traffic flow through the passageway. The machine vision technologies implemented in RAMS 10 include technology used in high-speed inspection applications. Traditionally, inspection and verification tasks were completed by human observers looking at individual pieces. However, as production line speeds increased, human inspectors were unable to keep pace with inspection tasks. Machine vision was developed as a solution for use in high-speed, complex environments such as production lines. In such applications, two-dimensional video imagery is used to capture an image of the part being inspected on a single plane (i.e., a two-dimensional plane having x and y axes). The imagery is then digitized and processed, using image analysis software, to extract information from the images and generate decisions about them.

Figure 3:
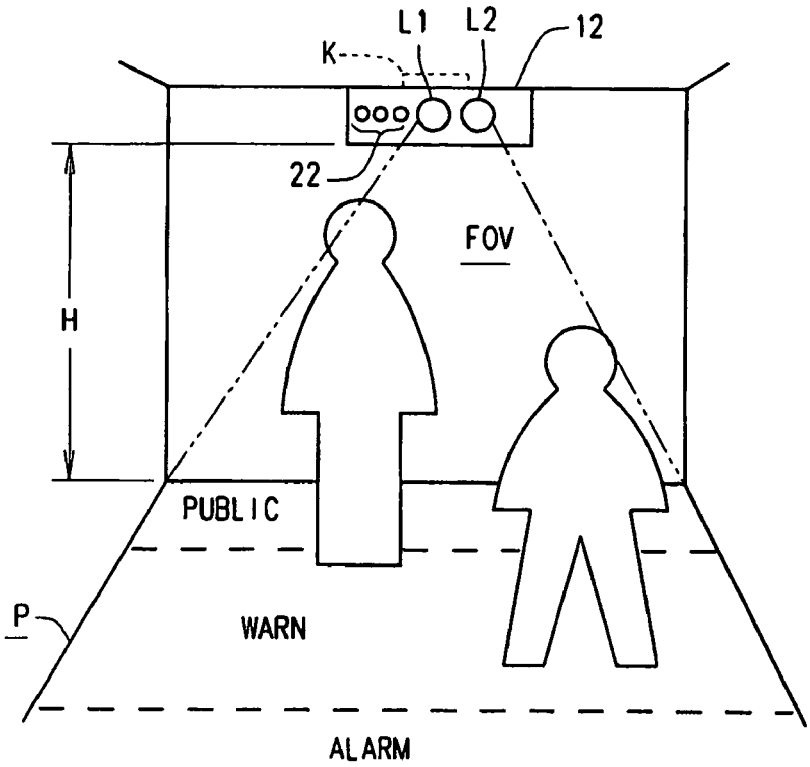
FIG. 3 illustrates an installation of a module incorporating a sensor suite for detecting people and tossed objects in a passageway.
Figure 4:
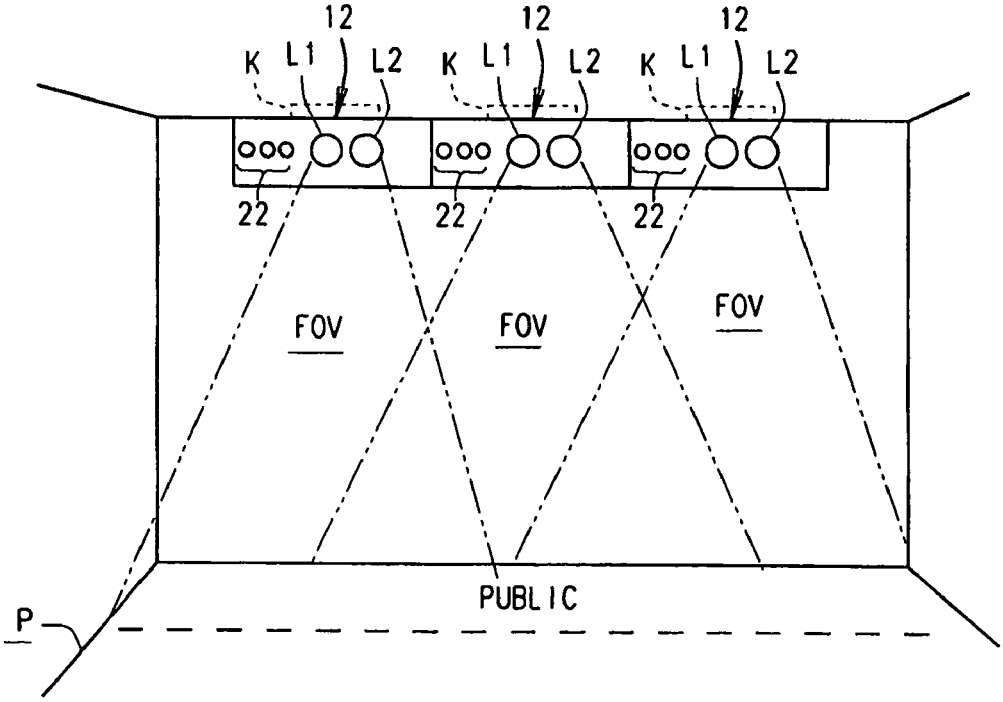
FIG. 4 illustrates an installation having multiple modules having overlapping fields-of-view so to effectively cover the entire area being monitored.

Two-dimensional monocular sensors, such as television cameras and the like, can accurately process x and y data, but they cannot distinguish between different levels (the z plane). For example, they cannot differentiate between an object on the ground and an object six feet off the ground. Unlike the monocular, two-dimensional imaging sensors conventionally employed in video detection systems, the sensor 16 used in RAMS 10 employs a stereovision sensor that examines a volume of space (x, y, and z axes). In one embodiment, the sensor employs two axially offset lenses L 1, L2 in FIGS. 3 and 4 that capture different views of the object (i.e., a person entering passageway P). During installation of the system, the sensors are adjusted so to have fields-of-view (FOV) which provide complete coverage of a passageway. This is as shown in FIG. 4. The sensor captures images at a high frame rate from each lens. RAMS 10 seeks detectable, defining features of an object (the person) in a frame, such as texture and edges, so to correlate points within the space. Because the lenses of the sensor are slightly offset from each other, they capture slightly different images of the same object in the same space at the same time.

As previously noted, processor 17 (or the "mini" processors) of RAMS 10 employs complex algorithms to perform the image analysis of each frame and compare frames of imagery captured by each lens. The program correlates texture and edge information contained in each frame to map objects within the frames and determine which features belong to the same object, so to define the object based on this information. Using data calculated from the positional offset of points on the object, RAMS 10 can not only pick out and map the object in two dimensions (x and y axis data), it can also assess depth information about the object (z axis data). This capability allows RAMS 10 to ignore irrelevant features such as shadows, glare, and reflections, because these have no depth associated with them as compared to people and other three-dimensional objects. Such a capability greatly reduces the number of false alarms that otherwise occur with monocular, video-based detection systems which employ conventional video cameras or sensors. Once sensor 16 has identified a person within the space, processor 17, using the image analysis algorithms that interpret the 3-D images, compares positional data for the person within the space from one point in time (frame of imagery) to the next. People are now accurately identified, as is their location and direction of travel in the passageway, despite changes in their size and shape from one frame of imagery to another. Based upon this analysis, if the person is detected as traveling in a wrong or disallowed direction through passageway P, an alarm signal is sent by processor 17 to computer 30 for RAMS 10 to generate an alarm.

It is further a feature of RAMS 10 that, in one embodiment using sensor 16, people and other objects (non-humans) are both identified and tracked. This is important because in an airport security application, for example, it is critical to track any object, human or otherwise, moving the wrong way through exit passageway P into the secured area. As with people, RAMS 10 can identify individual objects and assess whether they are traveling in a desired direction or in a wrong or disallowed direction. If an object is detected moving in the wrong direction, an alarm is generated by RAMS 10.

In one alternate embodiment of the invention, sensor suite 14 further includes a Thrown Object Detection Device (TODD) that employs a two-dimensional, extremely high speed near-infrared (IR) sensor 18 to capture and provide imagery of relatively small, fast moving objects that are move through the space. Sensor 18 "ignores" people and other large, slower moving objects (animals, luggage, etc.). However, as with sensor 16, if sensor 18 detects an object moving in the wrong direction through passageway P, an alarm is generated by RAMS 10.

Figure 6:
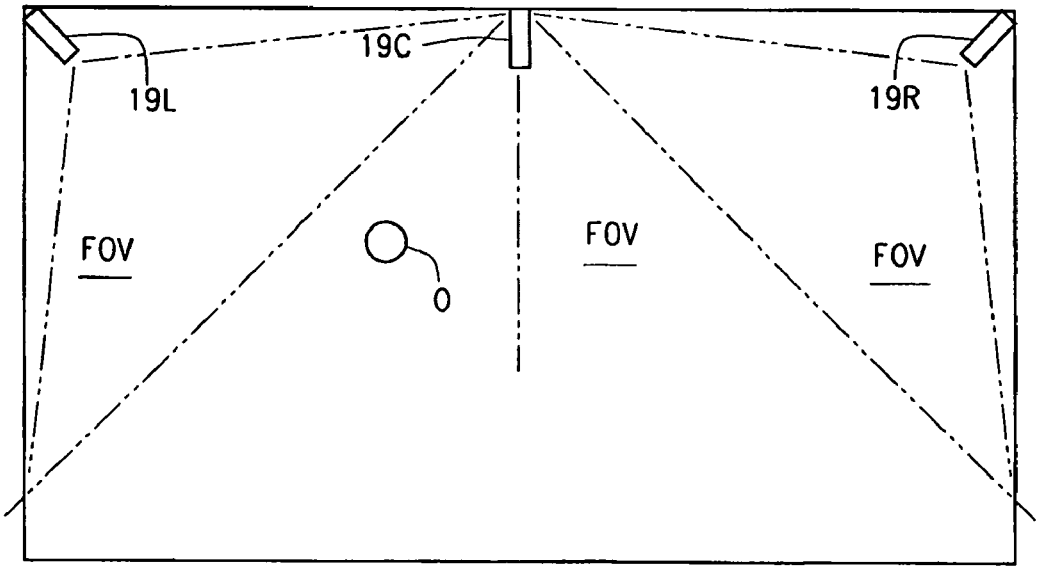
FIG. 6 is an illustration of a camera installation for detecting tossed objects.

Next, as shown in FIG. 6, in another embodiment of RAMS, the TODD includes at least two high speed cameras 19L and 19R. The cameras are installed above passage P. In a preferred embodiment, the cameras 19L and 19R are located above the left and right sides, respectively, of the passage (FIG. 6 illustrates the system as including at least one additional camera, such as a centrally mounted camera 19C, though such a camera is not required). In the configuration shown in FIG. 6, the cameras provide full coverage of the passage and there are no "blind" spots. In addition, each location within the space defined by the floor and sides of the passage are visible to at least one of the two cameras at all times. This makes it possible to triangulate an object 0 within the passage and find its location, in three-dimensional space. As with the other described embodiments, this configuration prevents false alarms otherwise resulting from shadows, reflections and highlights.

Figure 2:
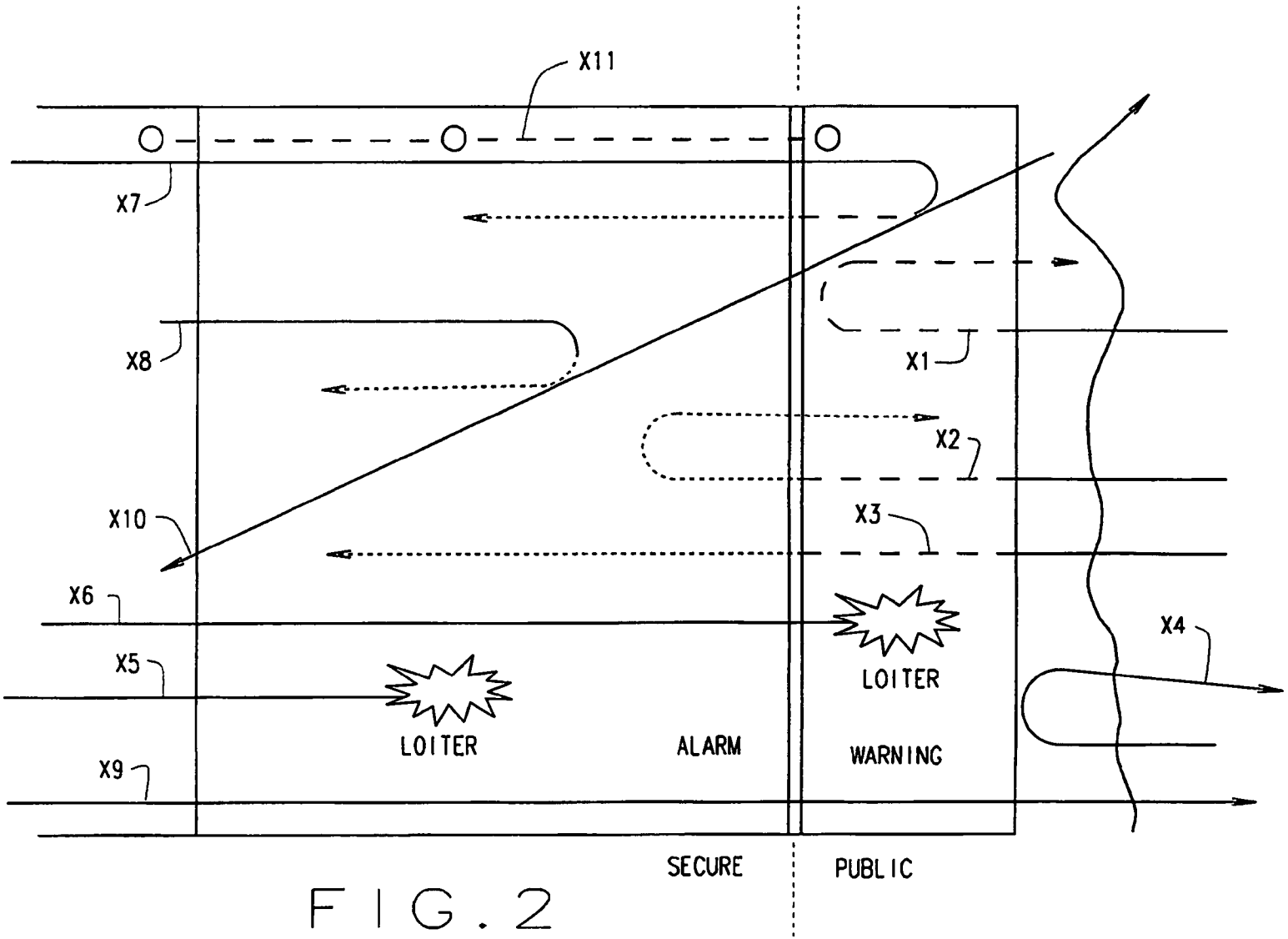
FIG. 2 is a representation of a passageway monitored by the system and indicating respective areas in which a warning or an alarm is sounded for different types of movement by people or objects through the passageway.

Referring to FIG. 2, RAMS 10 detects the movement of people and other objects moving through passageway P. In performing this function, RAMS 10 is designed to ignore certain exit activity (i.e., movement of people from the secure area into a non-secure, public area), but to generate warnings or alarms if a person or object is detected approaching or entering into the secure area from the public area using the exit lane, re-entering the secure area after exiting from it, or loitering in the area for longer than a predetermined period of time.

During system installation, RAMS 10 establishes two customized detection zones—a warning zone and an alert zone. Referring to FIG. 2, the two detection zones are established between the public area and the secure area of the facility. The warning zone is typically established within the public area and is adjacent to the alert zone. The alert zone begins at the boundary between the public zone and the secure zone, and is adjacent to the warning zone. In the one described embodiment of RAMS, within each zone, sensors 16 and 18 of sensor suite 14 monitor for wrong-way travel, by people or objects, from the public zone into the secure zone. Sensors 16 and 18 can be customized for each installation of RAMS 10 so the respective warning and alert zones can be adjusted for that particular site. In addition, specific items (i.e., the "coffee cup" effect) can be defined so that the presence of these will not cause an alarm to be generated. This customization further minimizes the number of false alarms generated by RAMS 10.

As noted, the warning zone IS a system-defined area in the public space immediately before the secured area. In operation, warning indications are generated when a person or object is detected moving the wrong way within the warning zone as indicated by the dashed lines X1, X2, and X3 in FIG. 2. The warning is generated even if the person doubles back as indicated by the line X1 while still on the public side of passageway P. However, if the person progresses from the warning zone to the alarm zone, an alarm is generated even if the person turns back into the warning zone as indicated by line X2, as well as if the person continues in the wrong way down passageway P as indicated by line X3. With respect to the person traveling path X2, the alarm will not be downgraded to a warning if the person returns to the public area; for once an alarm is generated, it cannot be downgraded. No warning or alarm is generated if a person approaches the warning area but never enters it as indicated by the line X4.

With respect to people or objects moving from the secure area into the public area, if a person goes from the secure area into the public area, then stops and loiters there, no warning or alarm is given. This is indicated by line X5. If they stop and loiter in the secure area for less than a predetermined period of time, no alarm is given. This is indicated by line X6. But if they loiter in the secure area for longer than that period, an alarm is given. If the person, having moved from the secure area into the public area, turns around and starts back toward the secure area, as indicated by line X7, a warning is given while the person remains in the public area; but, if the person re-enters the secure area, an alarm is given. Or, if the person turns around while still in the secure area and starts back down the passageway, as indicated by line X8, an alarm is given. If the person simply travels from the secure area into the public area and continues on their way, as indicated by line X9, no warning or alarm is given. When either an alarm or warning is sounded, the event is logged in at workstation 20 so operators of the system have a history of activity at that site readily available. This described hereinafter.

It is important to note that RAMS 10 is sensitive to, and detects, movement not only in both directions through the passage, but also movement which is not direct or a straight-line movement. If a person moves, for example, diagonally through the passage as indicated by line X10 in FIG. 2, or weaves their way through the passage in order to avoid or pass others moving through it, their movement is still captured and analyzed for detection purposes. Similarly, if an object 0 is thrown, tossed, rolled, or slid through the passage as indicated by line X11 in FIG. 2, its movement is still detected, even if it strikes people or other objects, bounces of the walls, floor or ceiling of the passage, is even caught by someone in the passage and relayed by them further down the passage in the disallowed direction.

Because it is a modular system, RAMS 10 allows for rapid installation at a facility with minimal disruptions to facility operations. As shown in FIG. 3, overhead module 12 comprises a single self-contained enclosure containing sensor suite 14 and processor 17, as well as installation hardware, wiring, cabling, etc. Module 12 is installed at predetermined height H above the floor of the passageway P being monitored. While this is typically ceiling height, if the ceiling is higher than the predetermined height, the module is still installed at the predetermined height H. Depending upon the size of the area being monitored, module 12 can be used singly, or in combination with other modules 12. In this instance, the multiple modules 12 are connected together to form a single unit. As shown in FIG. 4, when multiple overhead modules 12 are used, the area coverage provided by each module overlaps with that of an adjacent module so to insure complete coverage of the passageway.

The modules 12 are designed to be mounted to ceiling structures regardless of the type of material (plaster, plasterboard, ceiling tile, etc.) comprising the ceiling. Standardized adapter plate kits K are provided to simplify the overhead module installation process. These plates are light weight so they can be installed without adding bulk and weight to the overhead module. The plates also allow for universal attachment of the overhead module regardless of the installation conditions at the facility. The adapter plates are designed to be installed in one of a number of ways, so to accommodate most mounting requirements. Once an adaptor plate has been installed, the overhead module can be quickly mounted to the plate and connections to the module are made through a single point. Wires and cables run between overhead module 12 and operator workstation 20.

Figure 7:
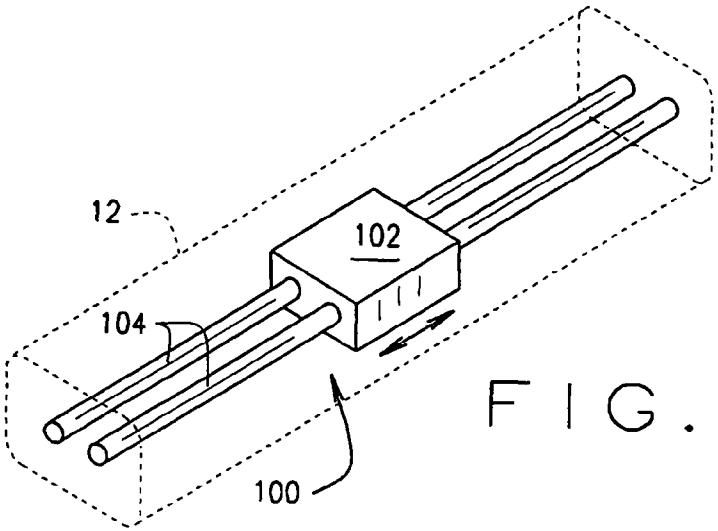
FIG. 7 illustrates a rail and carriage arrangement within a module for optimally locating a sensor suite to obtain proper coverage of a passageway.
Figure 8:
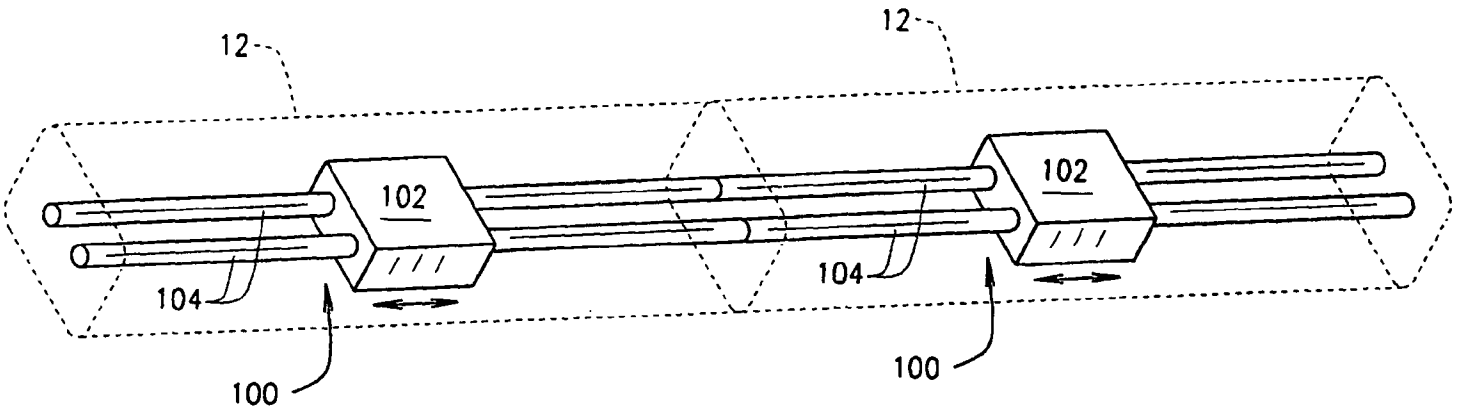
FIG. 8 illustrates a rail and carriage arrangement when two or more modules are linked together.

As shown in FIG. 7, a rail and carriage arrangement 100 is installed within each module 12. The suite 14 of sensors 16 and/or 18 is mounted on a carriage 102 for travel along rails 104 to properly position the sensors relative to passageway P. Once a module is installed above the passageway, calibration of RAMS 10 involves moving the carriage back and forth over the rails (as indicated by the arrows) until the FOV of the sensor suite covers the entire passageway. If the installation of more than one module is required for this purpose, then the rails 104 of the modules 12 installed above the passageway are linked together, as shown in FIG. 8, to form a common rail extending the length of the modules. Now, the carriages 102 are moved back and forth over the common set of rails until the FOVs of the respective sensors sufficiently overlap so that the passageway is entirely covered. While, in general, the carriages may be expected to be positioned midway along the length of each module, given the characteristics of the particular exit passage being monitored, the carriages may well be positioned substantially to one side of a module 12 in order to provide full coverage of the passage.

Each module 12 has three light emitting diodes (LEDs) 22*a*-22*c* on its front panel 24. One diode is blue when "on", one is yellow when "on", and the third is red when "on" (it will be appreciated that single or multi-color LEDs or other light emitting devices could be utilized, and the particular colors may vary). When the blue LED is "on" it means that the module has a problem or is in a By-pass Mode. If it is "off", it means the module is operating normally and is not in the By-pass Mode. If the yellow LED is "on", it means that the header and each sensor have power. If it is "off", it means one of the sensors is not functioning properly and, again, an alert is generated on the workstation display. If the red LED is "on", it means that an alarm indication has been generated by the module. An alarm indicator is illuminated on the workstation display, and audible tones are triggered. The red LED remains "on" until a manual RESET button on the workstation display is pressed. If the red LED is "off", it means no alarm event has occurred.

Figure 9:
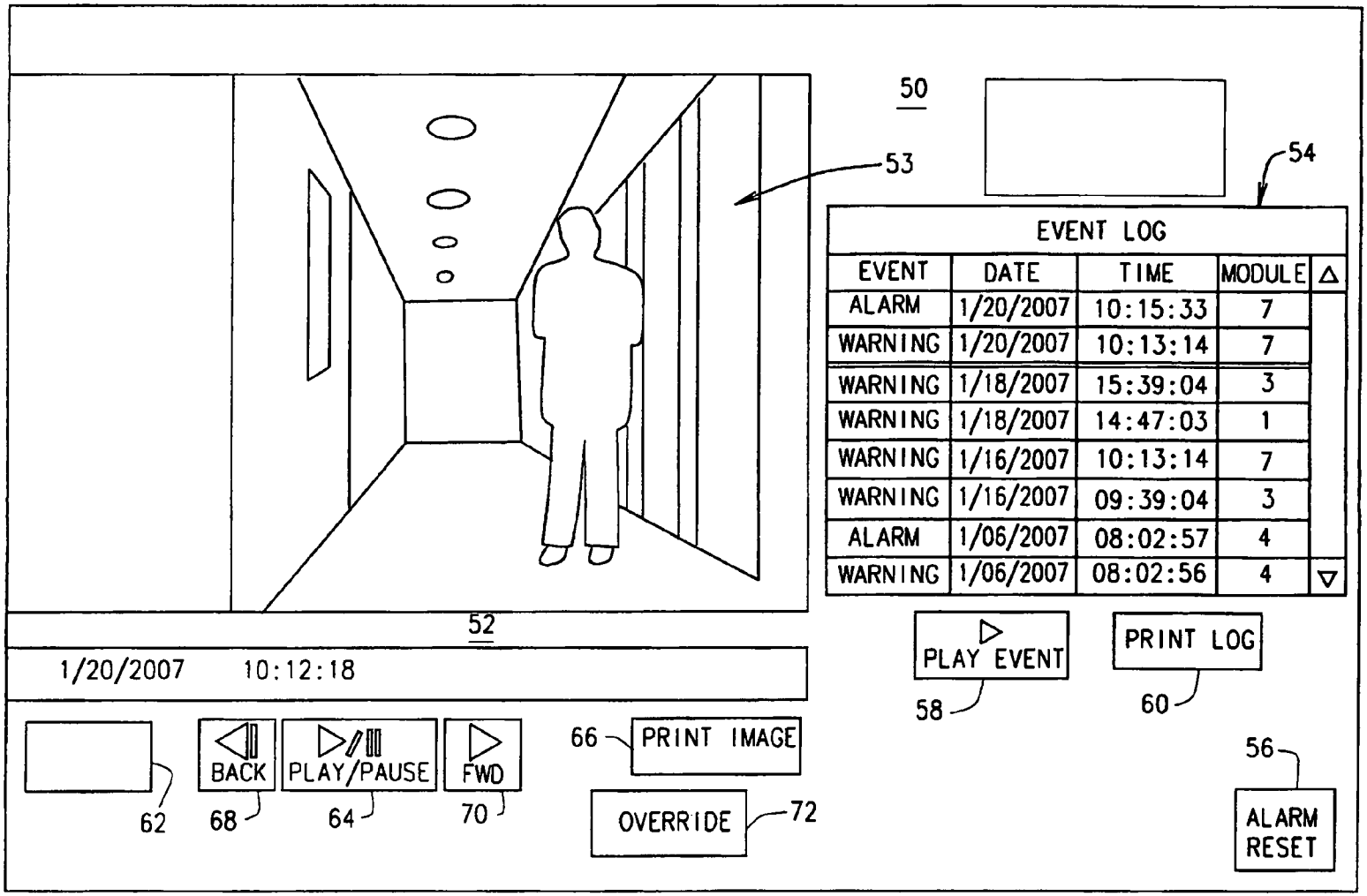
FIG. 9 is a representation of a monitor for viewing an event, together with an event log and controls used by an operator to process video and other information related to the event.

In the operation of RAMS 10, an alarm represents the highest level of a potential security threat and requires immediate attention. Alarms are presented in a number of ways. An alarm condition occurs, for example, when an intruder I such as shown in FIG. 9, is detected by RAMS 10. First, full color, high resolution event imagery showing intruder I is shown on a screen 52 of a display 50 at the workstation. If the event is an "alarm" event, the bezel 53 surrounding screen 52 turns red. At the same time, the red LED on overhead module 12 turns "on". An audio alarm is also generated. The event is automatically recorded by the OVR for automatic replay if the event is an "alarm" event; and, as previously discussed; the imagery of the intruder is automatically replayed. Occurrence of the event is also recorded and displayed in a log 54 adjacent screen 52. The alarm continues to be sounded and displayed until a supervisor resets the system. Also, red indicator light 46*a* on light stack 44 atop rack 26 is illuminated.

The event display log shown in FIG. 9 includes a number of entries. The log first includes "Event" entries which are provided in chronological order beginning with the most recent event. Entries are color coded so that, for example, the word "Alarm" under the event entry is displayed in red, while a "Warning" entry is displayed in amber. This makes it easy for an operator to readily distinguish between the types of events. Next, the log displays the date and time the event occurred. Lastly, the module housing the sensor which captured the event is listed. If the workstation is used for monitoring more than one egress passageway, listing the module identifies the location where the event occurred.

An "alarm reset" button 56 is located at the lower right hand side of the display. Pressing of the "reset" button by a system supervisor will "clear" the alarm. To thereafter subsequently view event video, an operator selects the event log 54 and presses a "play event" button 58 for the DVR to replay the recorded imagery. The contents of log 54 are printed by pressing a "print log" button 60.

A warning is a lower level indication of a potential security threat and may also require immediate attention. When a warning condition occurs, yellow indicator light 46*b* on the light stack illuminates as does the red LED on overhead module 12. Bezel 52 surrounding display screen 53 turns yellow. Now, a warning audio is generated, from the base of the light stack. This alarm sounds for any condition when any of the lights on the light stack are lit. The warning event is also recorded to video, and the occurrence of the event is displayed in log 54. To view warning event video, the event must be selected from log 54 and "play event" button 58 pressed. As with an alarm, a warning event is cleared by a system supervisor pressing "alarm reset" button 56.

Alerts are the lowest level of event indicators. An alert signifies an event of which a guard should be aware, but that does not pose an immediate security threat. Alerts typically indicate a system malfunction, including: (1) a sensor not functioning properly; (2) a sensor that is blocked; and/or (3) a system malfunction (e.g. power outage) has been detected.

Alerts are presented in a number of ways. The blue indicator light 46*c* on stack 44 illuminates, and bezel 52 on RAMS display screen 53 turns blue. An audio alarm is also generated.

RAMS operators interface with the system primarily through a dedicated RAMS display. This context-sensitive interface changes to display relevant data and activate relevant display interface elements. Operators preferably interface with the system through the touch screen display 28. There is normally no need to input text or alphanumeric data during typical operations; although a keyboard 32 is available (preferably, the purpose of this keyboard is for system set-up only).

When event analysis is performed, operators can review event imagery, print out screenshots, and print event log data. As shown in FIG. 9, RAMS display 50 comprises a graphical user interface which may include a series of buttons beneath display screen 53 for controlling viewing of the event imagery. As noted full-color, high resolution event imagery is shown on display screen 53. Also as previously noted, captured event is replayed on the screen, in a continuous loop of imagery, until the system is reset. During normal operations (i.e., non-event periods), pressing a "live view" button 62 beneath display screen 53 allows live imagery of passageway P to be viewed. This imagery, while recorded, is not stored in DVR 34. However, when an event occurs, this changes, and the DVR now begins to automatically store imagery beginning with the imagery captured five seconds prior to the event. This imagery is automatically looped on display screen 53, for an operator to immediately review it.

During a replay, the operator can freeze the display using a "play/pause" button 64, and can print any selected frame of video using a "print image" button 66. Pushbuttons 68 and 70 for "back" and "fwd" respectively allows the operator to move the playback frame-by-frame so to precisely select the best frame, or frames, for best viewing the intruder or tossed object. When the loop of imagery is paused by the operator, the "print image" function is activated so then pushing button 66 will cause the frame of imagery currently shown on display screen 53 to be printed. The event imagery and log data is printed on printer 36. This event imagery is also immediately transmitted from the workstation throughout the facility where the monitoring occurs. Since is done without first having to print the imagery and then disperse it, valuable time is saved in the critical period immediately after an event has occurred.

Events are stored in event log 54 for a predetermined amount of time after the event has occurred. After this time, event data can be retrieved by accessing DVR 34 directly and downloading the desired data. As noted, screen shots and other relevant event data can be printed to aid in event analysis and intruder apprehension using printer 36.

An "override" or by-pass button 72 is provided for use in situations where a known person (or object) has been authorized to pass through the detection zone the wrong way. Examples include law enforcement or emergency response personnel who must quickly gain access to the secured area.

The override button allows the operator to silence the audible tones and to suppress the visual indicators temporarily. The sensors will continue to function, and the associated event data will be recorded to the DVR. However, nuisance tones and visual indicators are suppressed. This function is activated by continuously pressing and holding the "override" button for the duration of the event. RAMS 10 will remain in the override mode only as long as the by-pass timer is set for. Once the timeout is complete the by-pass is released, the tones and visual indicators are available for activation. If a person is still moving the wrong way, or loitering in one of the detection zones, or a tossed object is still moving through the zones, the associated tones and indicators are activated. Through the use of a timer the operator does not need to continuously press the override button. The use of a timer also precludes accidental deactivation and accidental failure to restore the tones and indicators.

Additional aspects of the invention comprise a method and system for administering the RAMS 10. As indicated below, such administration may comprise obtaining and reviewing information captured by the system, and controlling the system. As indicated above, the RAMS 10 may include one or more operator workstations 20. One or more users may utilize each workstation 20. The one or more users may have different access to the system, i.e. the system may be configured to permit different users to interact with the system in different manners, including by selectively controlling access to different features or information.

In one embodiment, the workstation 20 may have a base or "basic user" mode. The workstation 20 may default to this mode. In one embodiment, the basic user mode may be configured to display a base graphical user interface or screen, which screen includes the display of live image information, a basic log of warning and alarm events, limited display of image information associated with an event, and limited system controls, such as an alarm reset, as illustrated in FIG. 9. In one embodiment, though the workstation 20 may be set to default to the basic user mode, a user may still be required to login to the workstation 20 (such as in a manner similar to that described below relative to a supervisor) in order for the workstation 20 to display the basic graphical interface or screen of information (otherwise, the workstation 20 may simply display a login screen or the like).

In addition, the workstation 20 may have one or more advanced modes or other levels of access. One such mode may be a "supervisor" mode or level of access. In one embodiment, the system is configured to provide access to advanced system functionality while in supervisor mode. As detailed below, such advanced functionality may comprise one or more of: (1) full video search capability by event type or date and time; (2) detailed supervisor log information, providing expanded event log categories; (3) supervisor log sort capability; (4) supervisor log print capability; (5) bypass button password change; (6) supervisor screen password change; and (7) a system bypass feature.

Figure 10:
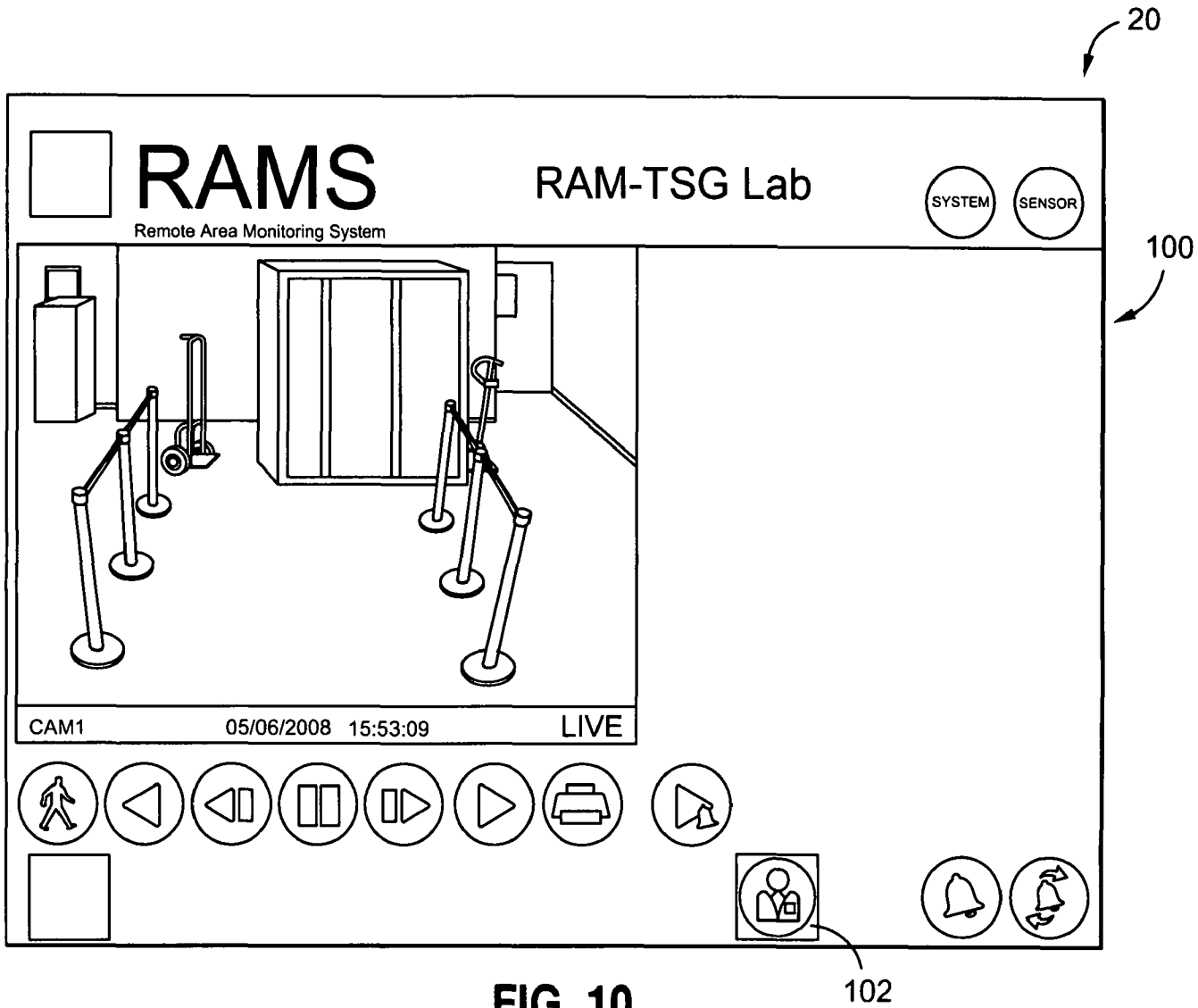
FIG. 10 illustrates a first graphical user interface which may be displayed by a workstation of the system of the invention.

In one embodiment, in order to access the supervisor mode, a user may be required to login as a supervisor. FIG. 10 illustrates a graphical user interface or screen 100 which may be displayed at the operator workstation 20. As illustrated, the graphical user interface 100 may have various areas and be configured to display text information, picture or moving image information, icons such as buttons, and other elements. In one embodiment, the graphical user interface 100 may include a supervisor login button 102.

Figure 11:
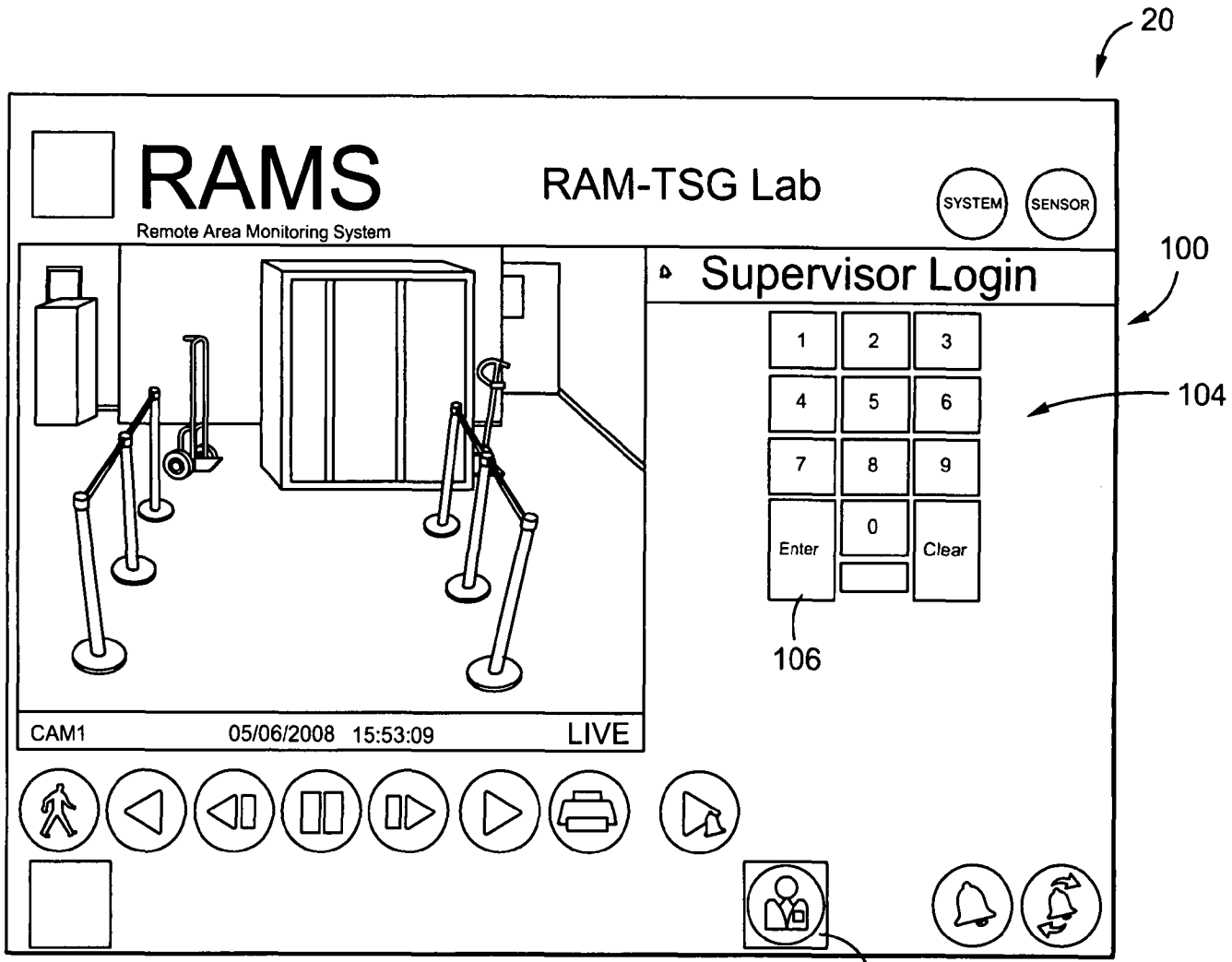
FIG. 11 illustrates a login graphical user interface.

Upon activation of the button 102, the user may be prompted to provide login information to establish supervisor or other level access. In embodiment, as illustrated in FIG. 11, a keypad 104 may be displayed (the keypad 104 is illustrated as buttons having associated numerical values, but the keypad could display alpha characters or other information, and the interface might accept information in other manners, such as via a text box). The user enters a password on the keypad 104 and presses an enter button 106 or otherwise transmits the information. In other embodiments, a user might be required to provide other or additional information to identify themselves and/or otherwise establish a particular level of access.

Figure 12:
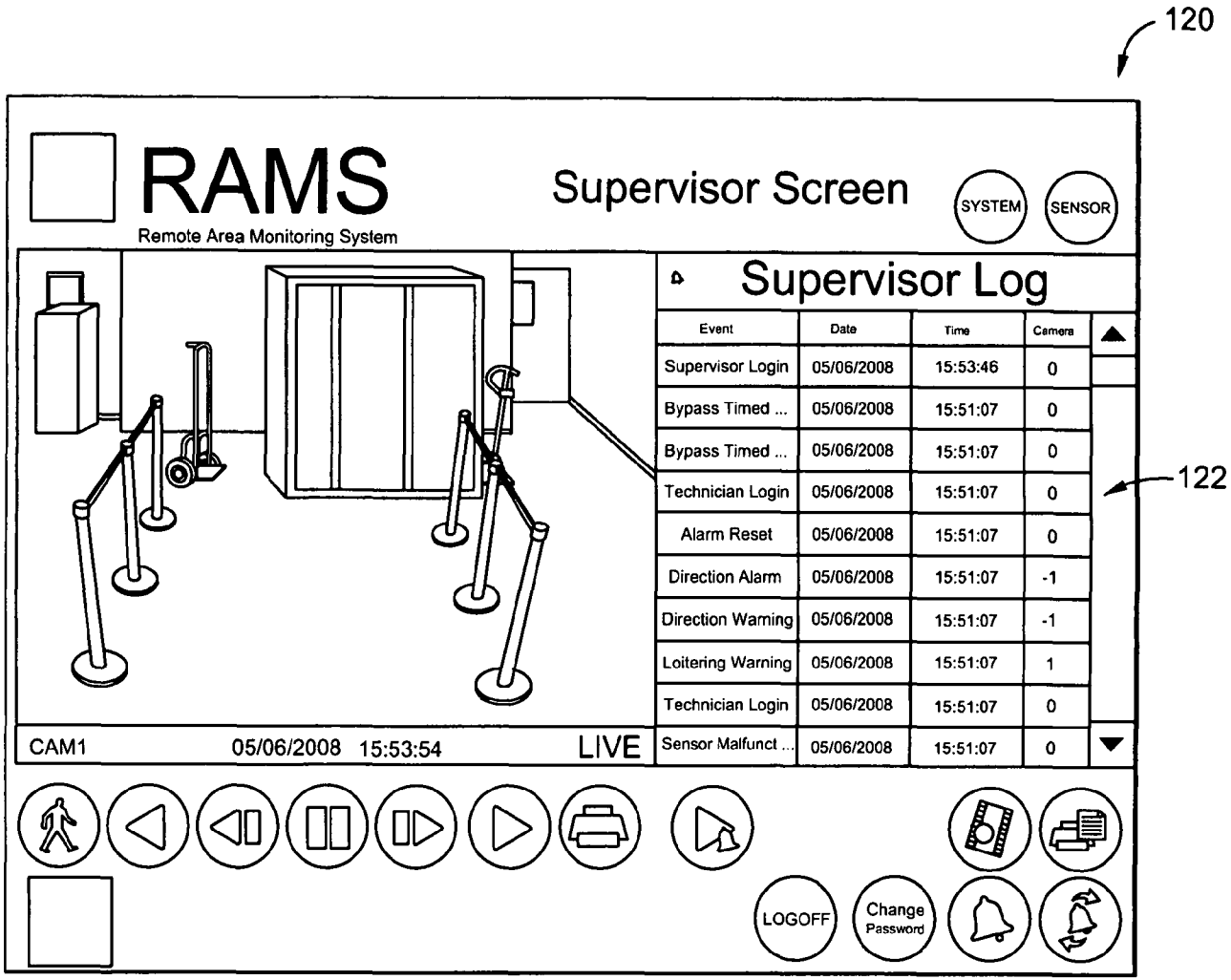
FIG. 12 illustrates a supervisor graphical user interface.

In one embodiment, information regarding one or more users is stored at the workstation 20 or a remote location. A user profile may be stored, the user profile identifying users and a level of access, and an associated password or other login information. In one embodiment, when the user provides their login information, that information is verified against the user records. If a match is found, then access information associated with that user may be utilized. In one embodiment, all users who login at the supervisor level may use a single supervisor password. If the user is assigned supervisory level access and/or they properly enter their login, then as illustrated in FIG. 12, the workstation 20 may be configured to generate a supervisor graphical user interface 120. It is noted that if the user inputs incorrect login information, then the user may be returned to the base display or interface, such as illustrated in FIG. 10.

Referring to FIG. 12, in one embodiment the supervisor graphical user interface or screen 120 may be configured to include a supervisor log 122. The supervisor log 122 may comprise a detailed event log. In this regard, the supervisor log 122 may include a detail of the alarm and warning events which are provided as part of the event log to normal users (see FIG. 9). However, the supervisor log 122 may include other events or information, such as logins to the system, system status information and the like. The information provided via the supervisor log 122 may comprise an identification of the particular event, the date and time of the event, and/or other information. Some of the events (other than alarms and warnings) that may be contained in the log may comprise one or more of:

(1) 24-Hour Bypass On: This event indicates that the system was in long-term bypass mode (the time period may be 24 hours or another period of time). Such a mode may be activated by a supervisor or technician and places the system in a non-active status. In one embodiment, if this mode is not manually reset, the 24-hour bypass would expire after a maximum of 24 hours.

(2) 24-Hour Bypass Off: This event indicates that the 24-hour bypass expired or was turned off.

(3) Alarm Reset: This event indicates that the alarm mode was reset, such as by activation of an alarm reset button.

(4) Bypass Timed On: This event indicates that a timed system bypass was initiated.

(5) Bypass Timed Off: This event indicates that a timed system bypass automatically expired.

(6) Database Malfunction: This event indicates that a database malfunction has been detected.

(7) Direction Alarm: This event indicates that a person or object was detected entering the secured area via the RAMS 10.

(8) Direction Warning: This event indicates that a person or object was detected approaching the secured area.

(9) Loitering Alarm: This event indicates that a person or object was loitering in the alarm zone.

(10) Loitering Warning: This event indicates that a person or object was loitering in the warning zone.

(11) Program Start: This event indicates that the RAMS™ system or control program was restarted, either manually or automatically.

(12) Sensor Malfunction: This event indicates that a sensor malfunction has been detected.

(13) Supervisor Login: This event indicates that a supervisor logged onto the supervisor screen.

(14) Supervisor Logout: This event indicates that a supervisor logged out of the supervisor screen, or the screen automatically timed out.

(15) System Malfunction: This event indicates that a system malfunction has been detected.

(16) Technician Login: This event indicates that a technician logged onto the technician screen.

(17) Technician Logout: This event indicates that a technician logged out of the technician screen, or the screen automatically timed out.

In accordance with one aspect of the invention, events in the supervisor log 122 can be sorted or arranged. For example, events in the supervisor log 122 may be sorted by touching the column headers on the workstation display. Events are then sorted either alphabetically or numerically (from highest to lowest value, for example). For example, clicking on the event header in the example log illustrated in FIG. 13A will sort the events alphabetically as illustrated in FIG. 13B. Touching the same header a second time will reverse the order of the list items. The user may be able to return to the chronological supervisor log 122 by selecting the date header twice, so that the current date is at the top of the list.

As indicated above, the RAMS 10 is configured to capture live image information and to store certain of that information. The workstation 10 is configured to display the live image information as well as the stored or pre-recorded images or video. In accordance with the invention, detailed video searches can be conducted to search for specific events in the supervisor log 122, or to find images or video for specific dates and times that are not associated with events.

Figure 15:
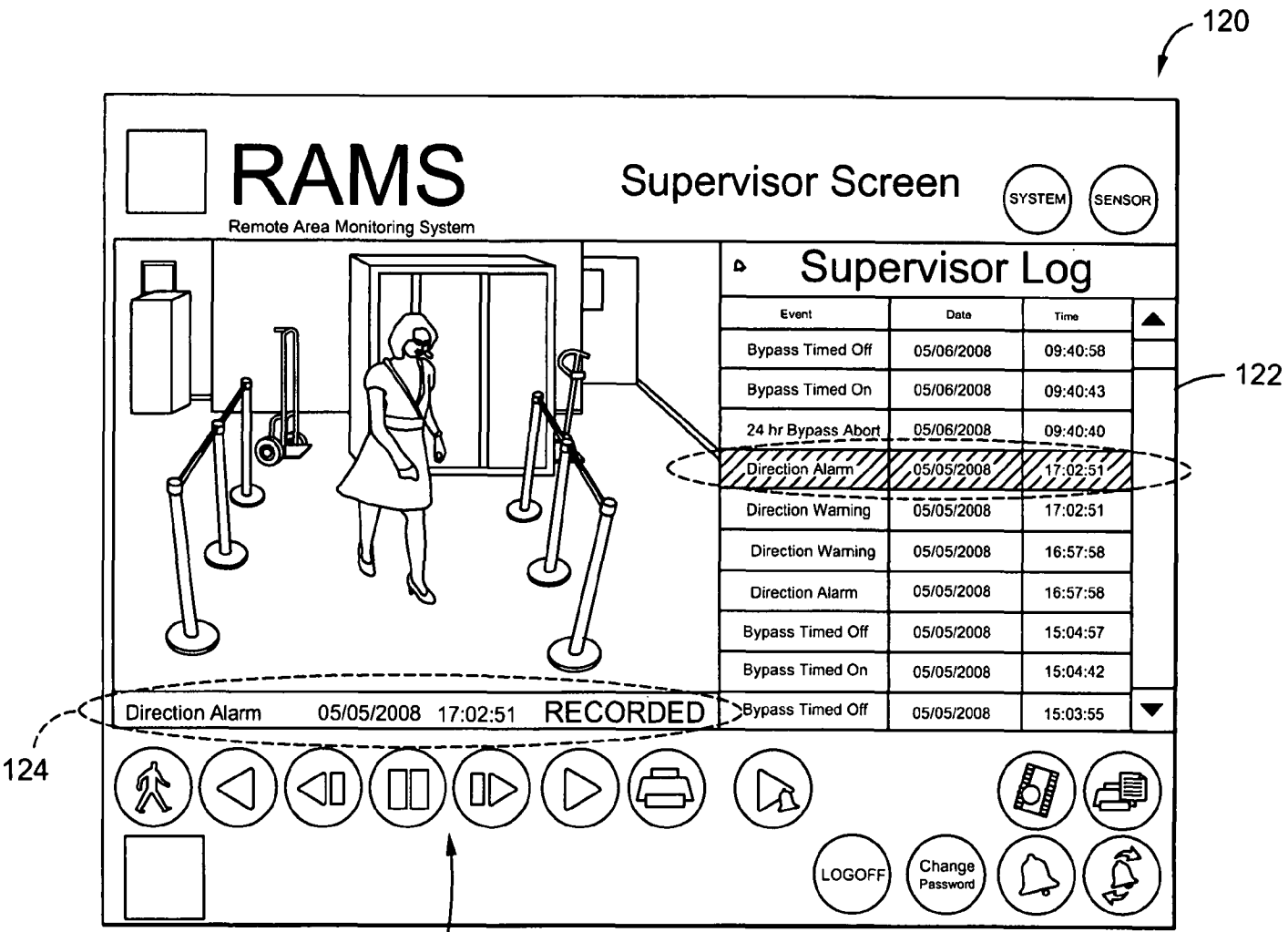
FIG. 15 illustrates a supervisor graphical user interface displaying stored or pre-recorded event information.

Referring to FIG. 15, when the supervisor interface 120 is displaying live video captured by the RAMS 10, the supervisor interface 120 is configured to indicate such. For example, the supervisor interface 120 may include a banner 124 at the bottom of the video screen. This banner 124 may provide information regarding the type and source of the image information which is being displayed. For example, the banner 124 may display the indicator "LIVE" to indicate that the video being displayed is being captured live or in real time. The banner 124 may also display the information "CAM 1", indicating the source of the image information. Of course, the banner 124 might also display additional information, such as the current date and time.

As detailed below, in various embodiments the image information which is displayed via the supervisor interface 120 may be previously recorded. In such event, the supervisor interface 120 may include various video controls 126 (some of those may be similar to those described above relative to the base user display as illustrated in FIG. 9). When the video is being displayed live, then the video controls 126 may be rendered inactive and may be displayed in a different fashion to indicate such, as by being grayed out.

As indicated, the workstation 20 may be configured to display pre-recorded information via the supervisor interface 120. If the image information was previously recorded, the banner may indicate such by the indicator "RECORDED", rather than "LIVE", along with the source of the video and the date and time of the recording, as illustrated in FIG. 15.

In one embodiment, recorded information is associated with a log event. In that embodiment, when the recorded information is displayed, the associated log event is also highlighted in the supervisor log 122.

In one embodiment, the image information is displayed in a continuous loop until stopped. Further, the supervisor interface 120 may display the video controls 126 as active (such as in the color blue).

Figure 14:
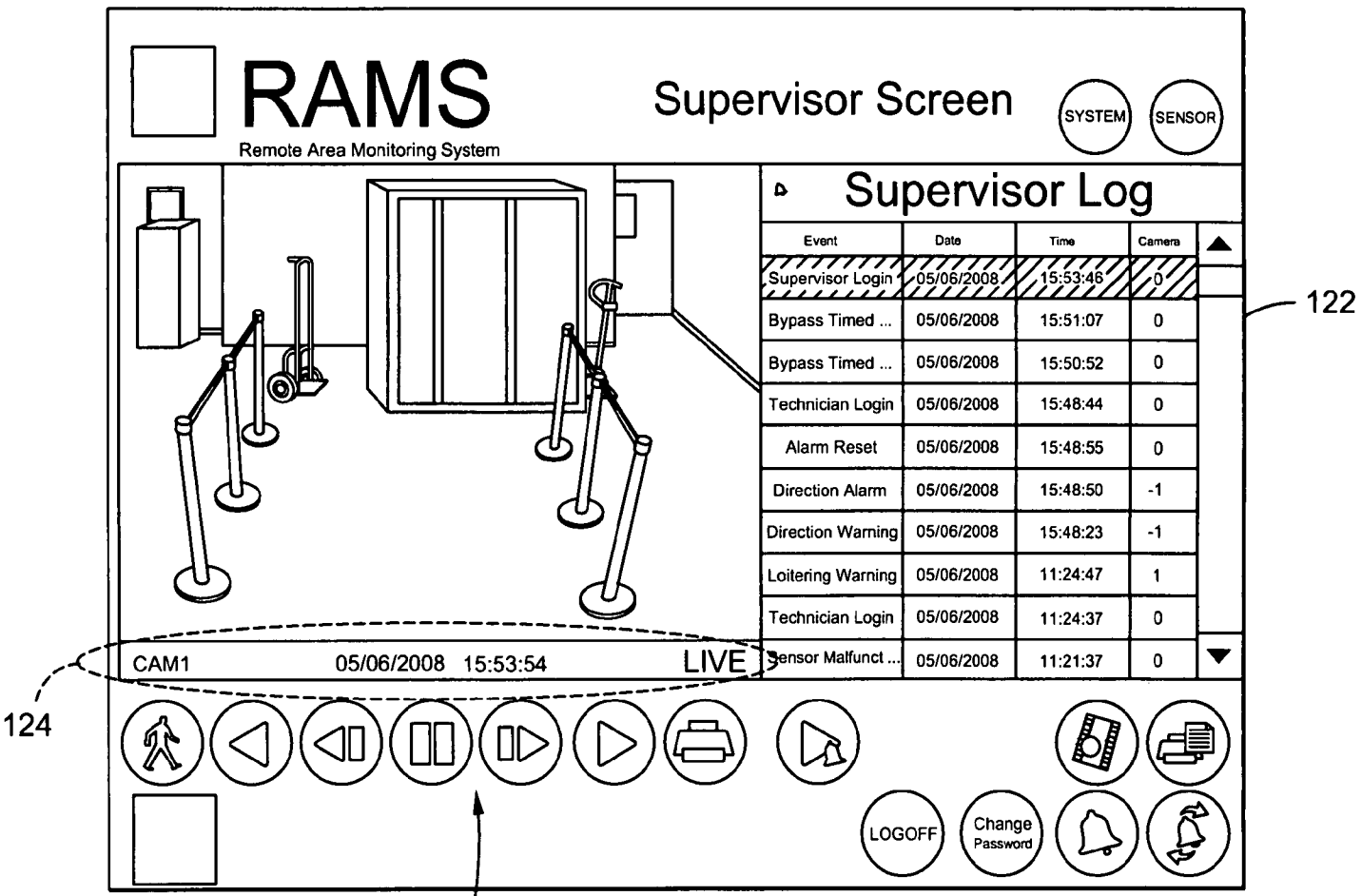
FIG. 14 illustrates a supervisor graphical user interface displaying live event information.

In one embodiment, if a user is viewing pre-recorded image information and a live event occurs (such as a warning or alarm event), then the workstation 20 is configured to stop displaying the pre-recorded event and immediately display the live information regarding the event. For example, the pre-recorded video is stopped and live video information is presented. In that event, a notification is provided to the user, such as by the banner 124 displaying a "LIVE" indicator and the source of the information, as illustrated in FIG. 14.

Figure 16:
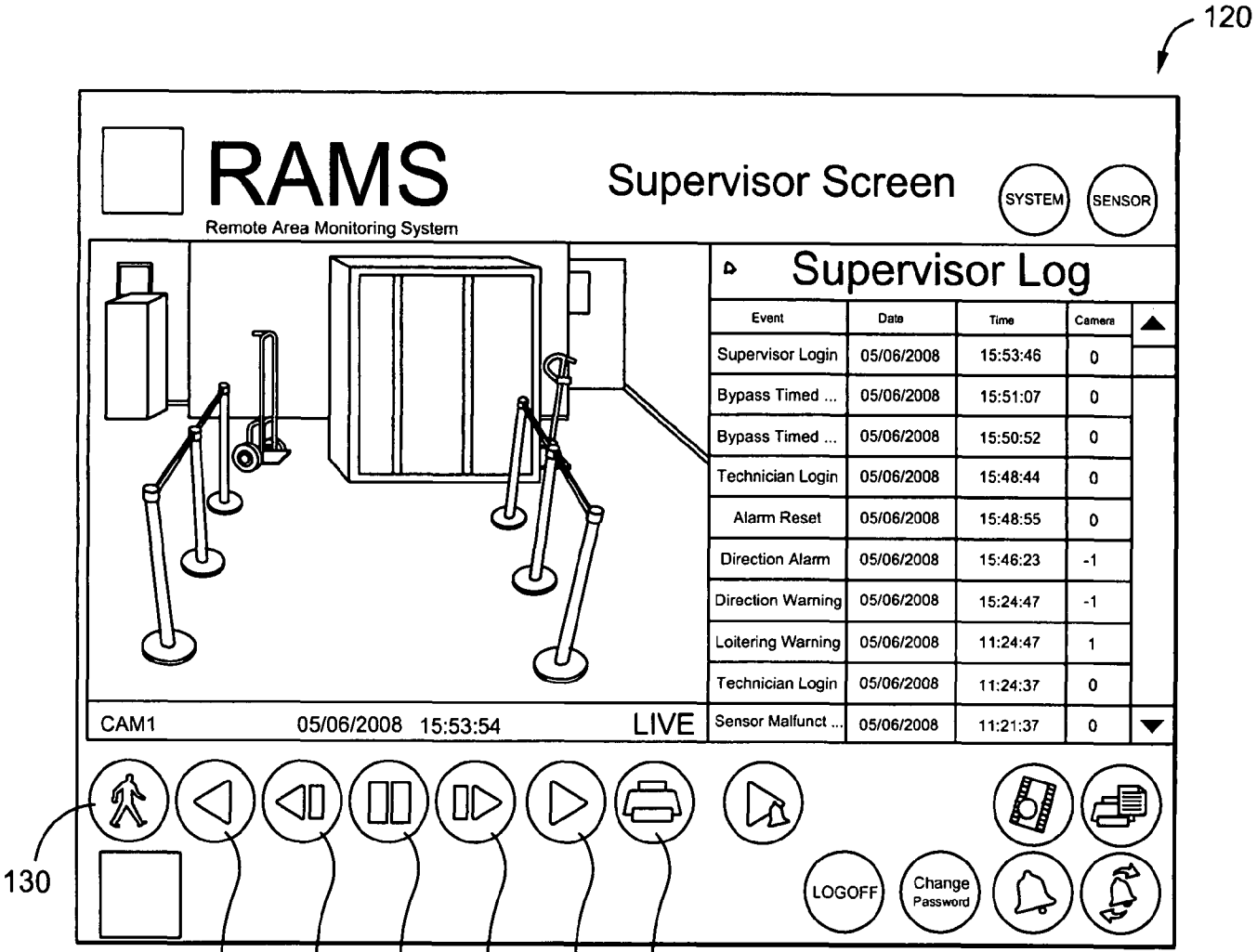
FIG. 16 illustrates video controls of a supervisor graphical user interface.

In one embodiment, one or more of the supervisor video or image controls 126 may be unique to the supervisor mode (and may be different than those controls provided to other types of users). Referring to FIG. 16, in one embodiment, supervisor video controls 126 may comprise one or more of the following, including associated buttons or other graphical elements corresponding thereto: (1) display the live view 130; (2) display pre-recorded image information (via selection of an event from the log 122); (3) play pre-recorded image information in fast time 132 (2× normal speed, for example) and/or fast forward pre-recorded image information 134; (4) rewind pre-recorded image information 136 and/or play pre-recorded image information in rewind in fast time 138; (5) pause pre-recorded image information 140; and (6) print image information 142. In one embodiment, the video controls may also permit a user to conduct a video search. Such a search may be configured to search image information by bookmarks or other indexes, including time stamps or the like.

Figure 18:
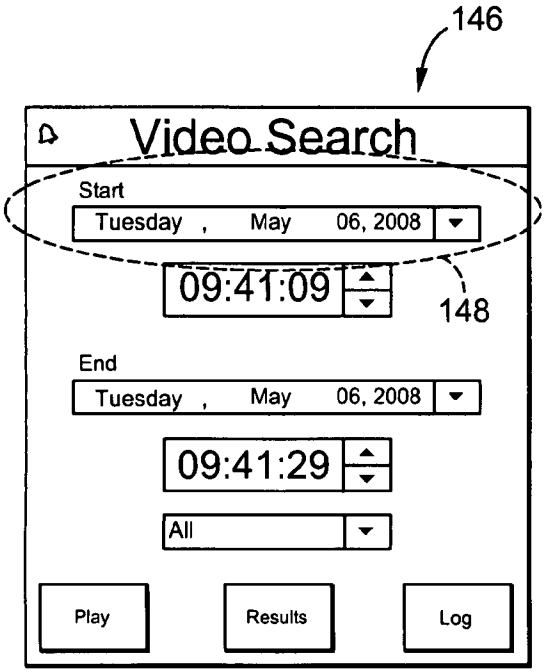
FIG. 18 illustrates a date selector of the video search function display.

As indicated above, the workstation 20 is preferably configured to store captured image/video information and associated event information. Preferably, supervisors have the capability to perform detailed searches of the stored information. A supervisor may begin a search by pressing a video search button 144. In response, the workstation 20 may be configured to display a video search window or screen 146, such as illustrated in FIG. 18. Such a window 146 might be displayed as part of the supervisor display 120, or be displayed as a window over such a display. In one embodiment, the video search display or window 146 displays information such as search fields pre-filled with data. In one embodiment, the information pertains to the particular event that was selected in the supervisor log 122.

In one embodiment, any alarms must be reset before a video search can be initiated. Alarms cannot be reset while the video search screen is displayed. In one embodiment, a supervisor can press one or more of the buttons to exit the video search display.

Still referring to FIG. 18, as one aspect of the video search feature, a supervisor may define a start date and time for the search. A user may change the start date, such as by pressing on an arrow in a start date field 148. In one embodiment, such a selection causes the display of a calendar in or over the window. The user may then select a start date from the calendar. In one embodiment, only dates with stored data can be selected.

Figure 19:
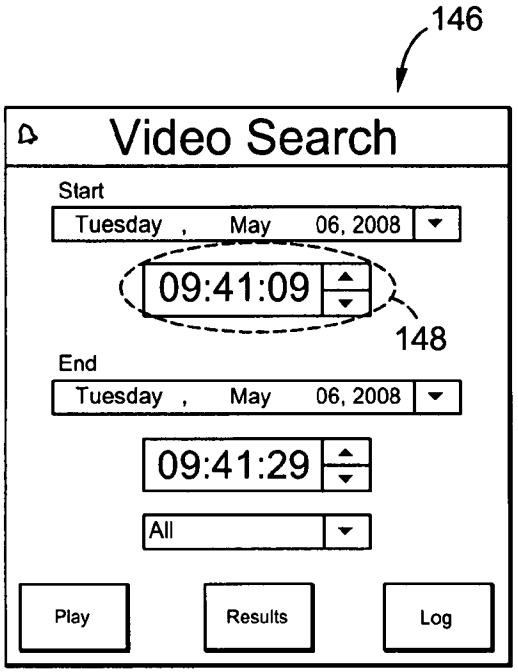
FIG. 19 illustrates a time selector of the video search function display.

A user may also change the start time by pressing the appropriate section (hour, minute, second) within a start time field 148, as shown in FIG. 19. For example, by using the up/down arrows, the user may increase or decrease the value in the field. The user might also enter numerical data into the data fields.

Figure 20:
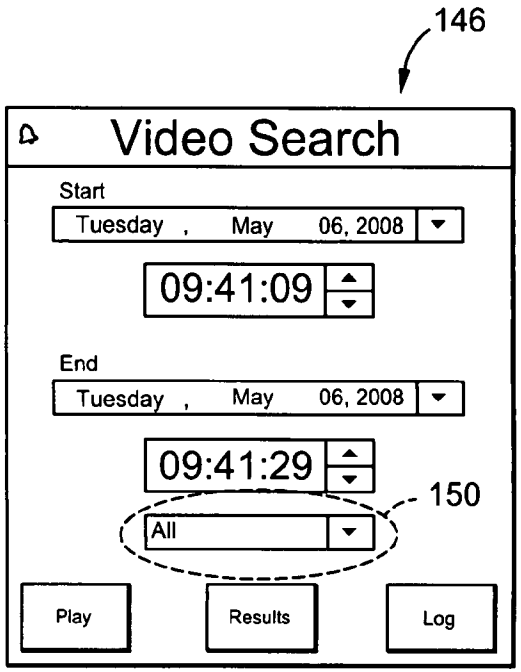
FIG. 20 illustrates an event selector of the video search function display.

The user may repeat the same process to change the end date and time for the search using the same method as described for changing the start date and time. The user may then select the type of event to search. As illustrated in FIG. 20, the search video window 146 may include a dropdown list.

Once the user has entered the desired search criteria, the stored video data is searched for relevant results. In one embodiment, results are displayed in the log portion of the supervisor interface 120 or in a search results window. The results preferably identify any events which meet the date/time range and even type as specified by the user. The user may select a result from the list of results. When the event is selected and the user presses a play event button 156 as illustrated in FIG. 17, the image information associated therewith is displayed.

Figure 17:
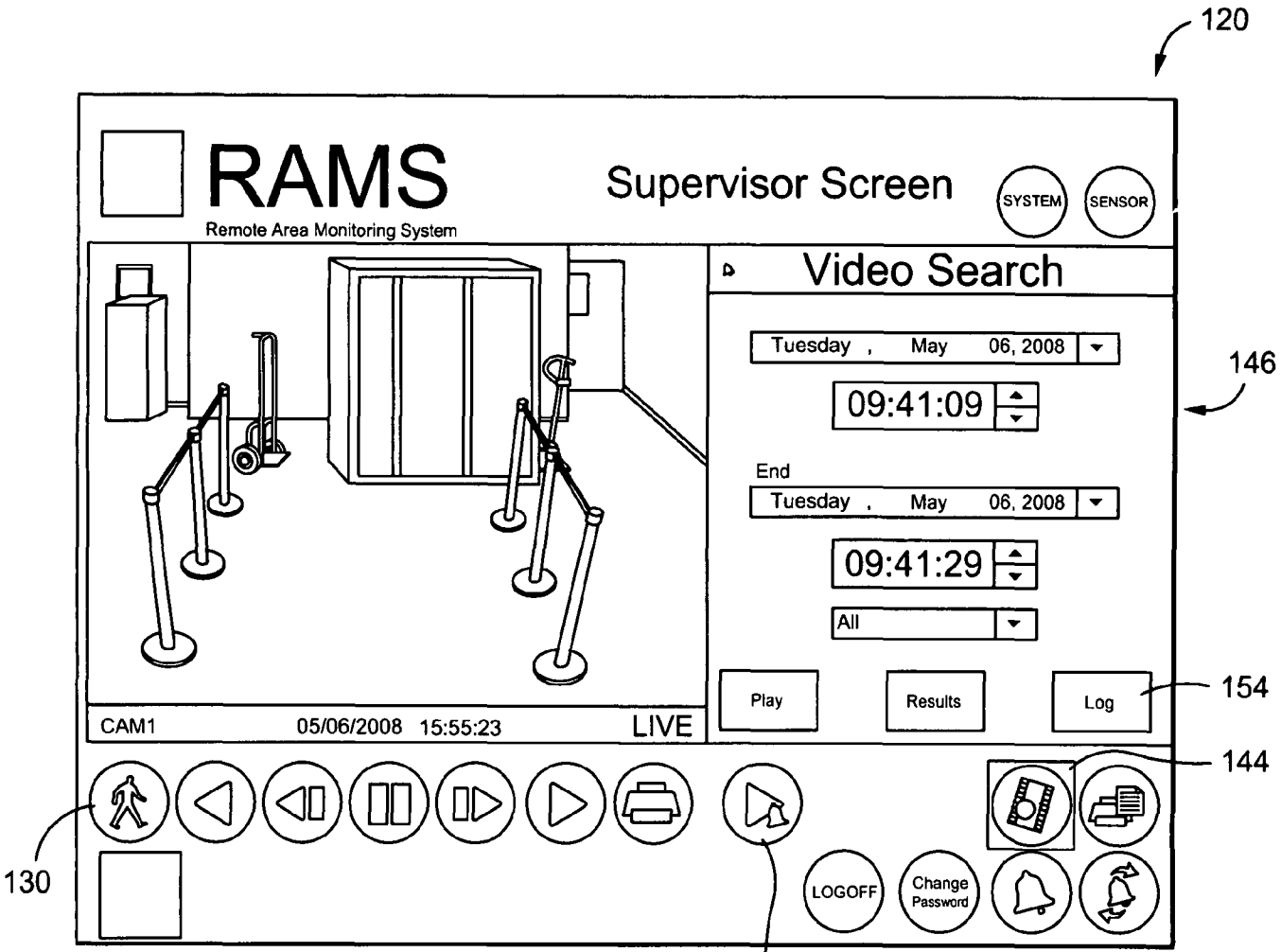
FIG. 17 illustrates a video search function display of a supervisor graphical user interface.

In one embodiment, the user may return to the main supervisor interface 120 displaying the supervisor log 122 of results by accessing the video search window 146 and pressing the video search button followed by pressing a log button 154, as illustrated in FIGS. 17 and 20. Upon completion, the user exits the recorded video and returns to the live view by pressing the live view button 130 (as illustrated in FIG. 17).

As indicated above, if pre-recorded image information is being played when an alarm or warning event occurs, the new event imagery will automatically take the place of the recorded imagery. Results of a previous search can be retrieved by pressing a previous results button.

Figure 21:
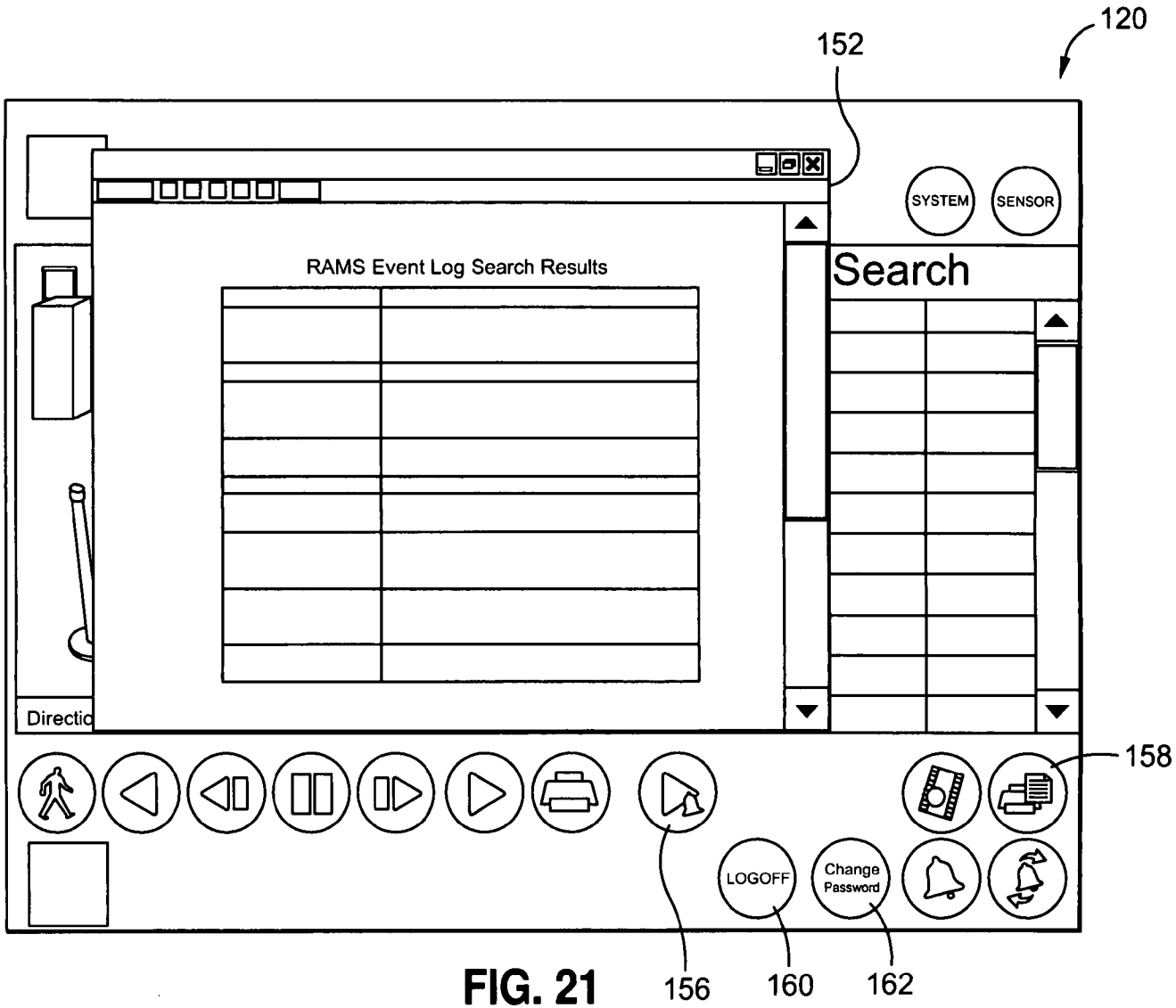
FIG. 21 illustrates a video search results window.

As one aspect of the invention, items displayed in the search results window can be printed by pressing a print search results button 156, as shown in FIG. 21. In one embodiment, this will open a print preview window 152 showing the layout of the log items as shown in FIG. 21. The user then presses the printer icon at the top right of the print preview window to print the results. Alternatively, the user may press a close or "X" button at the top of the print preview window to cancel out of the print function.

A user may log off from the workstation 20 and the supervisor interface 120 by pressing a log off button 160. Also, if there is no activity relative to a supervisor interface or screen 120 for a preset amount of time, the system may automatically close or log out of the supervisor screen and return to the main user screen. A pop-up window or other notification may confirm that the supervisor screen has been logged off.

In one embodiment, a supervisor is also provided with the capability to change one or more passwords, such as the login password for the supervisor or the password necessary to affect a bypass of the system. The password to access the supervisor screen and the bypass button may be changed by selecting a change password button 162. One embodiment of changing a passwords is as follows: (1) select a change password button 162; (2) select which password to change (e.g. supervisor login or bypass); (3) display a window with a keypad; (4) enter the current password; (5) enter the new password; and (6) re-enter the new password; and (7) display a notification confirming that "[Supervisor or Bypass] password changed".

If the password change screen was accessed accidentally, the user may press a cancel button to exit the password change screen and return the main supervisor screen.

In one embodiment, the workstation 20 is configured to display a bypass button 164 at one or more times as part of the supervisor interface 120. When a user selects this button 164, the system is preferably configured so that various portions of the RAMS 10 are de-activated or turned off for a period of time, such as the visual indicators and auditory sounder. This feature may be used, for example, in cases where authorized individuals, such as law enforcement officials or emergency responders, must pass through a monitored area in the wrong direction. The system is preferably used in conjunction with airport regulations, processes and procedures to ensure that proper security measures are taken to secure the area prior to initiating bypass.

The bypass button 164 is preferably password protected ensuring only authorized users can enable the bypass feature. For example, when the bypass button 164 is selected, a keypad may be displayed for receiving a bypass password which must be verified before the bypass is activated.

In one embodiment, the system incorporates two different types of bypass: a 24-hour bypass and timed bypass. The 24-hour (or other predefined period of time) bypass puts the system into bypass mode for a maximum of 24 hours. After 24 hours, the system will automatically take itself out of bypass and restore normal alerting functionality. This feature is useful in cases where the system is being serviced or accessed for extended periods of time to avoid nuisance alarms. Preferably, however, this feature is used infrequently.

The timed or "instant" bypass will turn off the system's indicators and sounder for a brief period of time, such as 20 seconds. This feature is useful in cases when authorized personnel need to pass through the system. The length of time for which timed bypass is active may be adjustable. Again, in order to activate this bypass mode, the user is preferably required to enter a password. A different password may be required to activate each of the 24 hour and timed bypass modes.

Figure 22A:
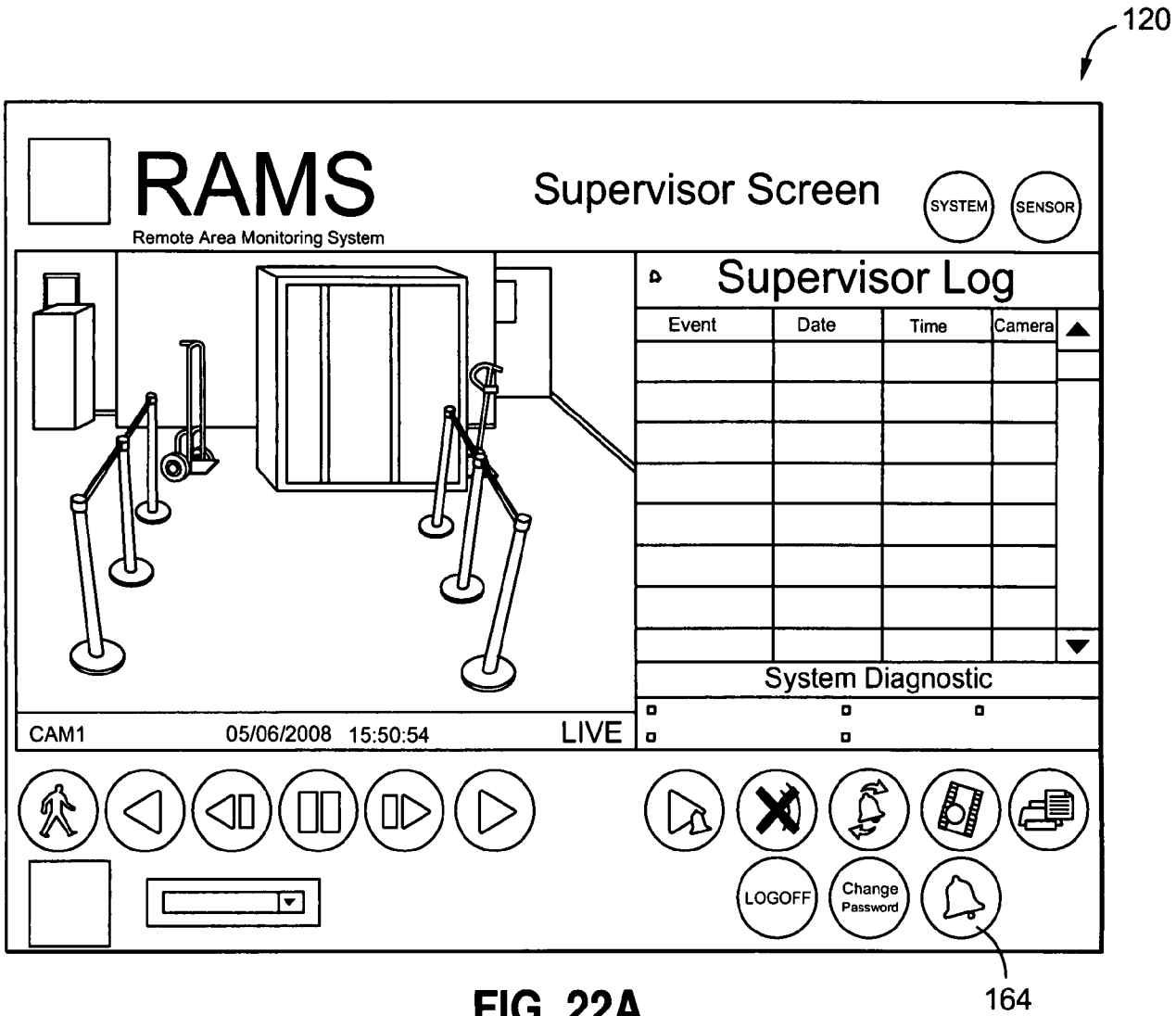
FIGS. 22A and 22B illustrate a supervisor graphical user interface including alarm bypass and alarm reset elements.
Figure 22B:
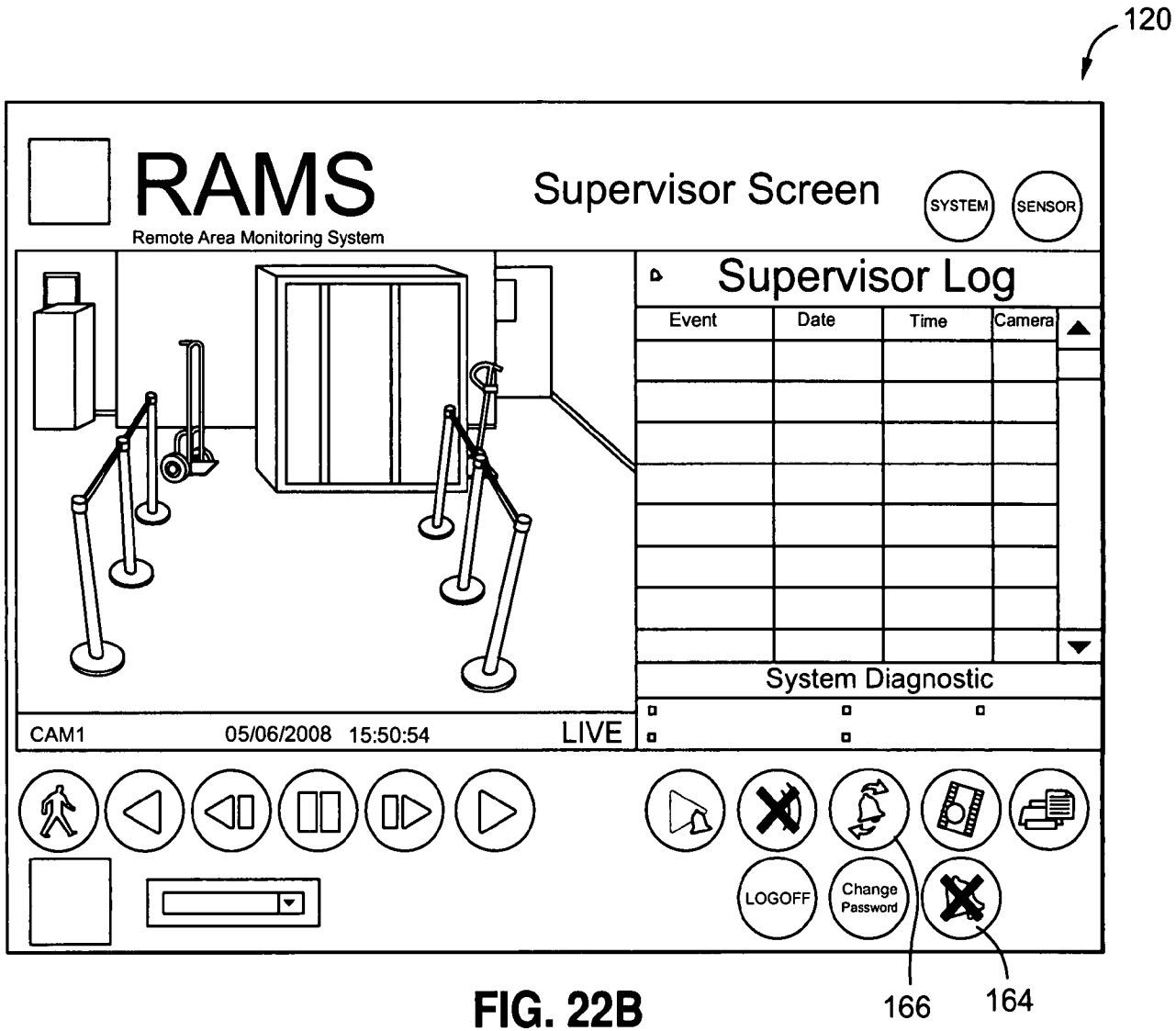

When the RAMS 10 is in 24-hour bypass, the bypass button 164 may include a red "X" or other indicator, such as illustrated in FIG. 22B (in one embodiment, the border background may also turn blue in color). When the system is in timed bypass, the bypass button may be grayed out for the few moments that the system is in bypass mode (since the bypass button 164 cannot be reactivated for the duration of the timeout). For both bypass modes, a blue stack light may illuminate and a bypass event is preferably recorded and highlighted in the event log.

When the bypass has timed out, the system will automatically return to its normal ON state. At time, the system is configured so that all sensors, visual indicators and sounders return to their active or "ON" state.

As illustrated in FIG. 22B, the supervisor interface 120 may include an alarm reset button 166 or indicator. This button 166 is preferably inactive until an event is detected. Once an event has been detected and the associated visual and auditory indicators are initiated, the alarm reset button 166 is activated. To reset the visual and auditory indicators, the user may press the alarm reset button 166.

In other embodiments of the invention, other types of users of the workstation 20 and RAMS 10 may be defined. For example, one or more technicians may be permitted to access the workstation 20 and the system may have a corresponding technician level or mode. In response to an appropriate login, a technician graphical interface or screen may be displayed. In one embodiment, this graphical user interface may allow a technician to access various system administration features (rather than system output features, i.e. rather than accessing live and stored image information, event logs and the like). For example, a technician may be permitted to run a system check, be provided with a log of system errors or malfunctions, change various system parameters (such as the timed bypass duration) or the like. Of course, the technician login may require a different password or login information than other users.

As indicated, the workstation 20 may comprise various hardware devices, such as similar to a personal computer. The various aspects of the system administration may be implemented by hardware and/or software. For example, the various graphical user interfaces may be generated via software which is executed by a processor of the workstation 20, and which causes the display thereof to display the graphical user interface. It will also be appreciated that the various graphical user interfaces and the appearances thereof may vary. For example, the buttons or other indicators may have various colors, shapes and the like, and may or may not include associated textual identifiers. In addition, various information displayed by the graphical user interfaces or screens may be display as frame of a single screen, or in "window" fashion wherein windows may overlap one another.

It will be appreciated that the RAMS 10 may include more than one workstation 20. In such event, users of the different workstations 20 may be permitted to login at different levels. For example, a user of one workstation 20 may login or use the workstation in basic user mode. A user of another workstation 20 may login or use the workstation in the supervisory mode. In such a configuration, one workstation 20 may include the DVR 34 or otherwise store information, and the other workstations 20 may access that workstation in order to obtain the stored information.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A system for passively and unobtrusively detecting movement of people or objects through a passageway where detection of people or objects moving in a disallowed direction through the passageway is critical and a rapid response to a detected movement necessary comprising:

a stereoscopic sensor sensing the person or object as it moves through the passageway in any direction and generating successive individual frames of three-dimensional imagery of the object;

a processor integrated with the sensor and processing the individual frames of imagery to distinguish the person or object from other people and objects simultaneously moving through the passageway regardless of the direction of movement of the people and objects;

an alarm indicator responsive to an input from the processor if the processor determines a person or object is moving through the passageway in the disallowed direction to promulgate an alarm whereby any people or objects moving in the disallowed direction are passively and unobtrusively detected and their movement reported; and at least one workstation, said workstation including at least one display configured to display a graphical user interface and one or more of said individual frames of imagery generated by said stereoscopic sensor, said alarm indicator being incorporated in said workstation to provide an alarm indication using the display.

2. The system in accordance with claim 1 wherein said workstation further comprises at least one digital video recorder configured to store one or more of said frames of imagery generated by said stereoscopic sensor.

3. The system in accordance with claim 1 wherein said workstation further comprises a computing device, and wherein said computing device is configured to generate said graphical user interface.

4. The system in accordance with claim 1 wherein said workstation is configured with at least a first level and a second level of access.

5. The system in accordance with claim 4 wherein said workstation is configured to permit access to different information associated with said system depending upon said first level or second level of access.

6. The system in accordance with claim 5 wherein a second level of access comprises a supervisor level of access and provides access to one or more of the following features not available via said first level of access: a supervisor log, full searching of stored frames of imagery, and system configuration settings.

7. The system in accordance with claim 6 wherein said system configuration settings comprise a password change.

8. The system in accordance with claim 6 wherein said supervisor log permits print and sort capability of entries in said log.

9. The system in accordance with claim 1 wherein a configuration of said graphical user interface depends upon a level of access to said workstation.

10. The system in accordance with claim 1 wherein said workstation is configured to display alarm information in response to said alarm indicator.

11. The system in accordance with claim 1 wherein said workstation is configured to create an event and store one or more of said frames of imagery corresponding to each alarm indicator.

12. The system in accordance with claim 11 wherein said workstation is configured to display a log of said events via said graphical user interface.

13. The system in accordance with claim 12 wherein the types of events which are displayed as part of said log are determined by a level of user access to said workstation.

14. The system in accordance with claim 12 wherein said workstation is configured to display the frames of imagery associated with an event which is selected from said log.

15. The system of claim 1 in which a monitor is installed in the workstation for viewing the frames of imagery and the alarm indicator includes a bezel surrounding the monitor, the color of the bezel changing from one color to another when an alarm condition occurs.

* * * * *